US011555648B2

(12) United States Patent
Voltarelli et al.

(10) Patent No.: US 11,555,648 B2
(45) Date of Patent: Jan. 17, 2023

(54) STORAGE STRUCTURE FOR REFRIGERATOR APPLIANCE

(71) Applicant: Electrolux Do Brasil S.A., Curitiba (BR)

(72) Inventors: Antonio Voltarelli, Curitiba (BR); Israel Mercer, Curitiba (BR); Rafael Leidens, Curitiba (BR); Alcione Colecha, Curitiba (BR); Guilherme Picanço, Curitiba (BR)

(73) Assignee: Electrolux do Brasil S.A., Curitiba (BR)

( * ) Notice: Subject to any disclaimer, the term of this patent is extended or adjusted under 35 U.S.C. 154(b) by 0 days.

(21) Appl. No.: 16/971,517

(22) PCT Filed: Mar. 2, 2018

(86) PCT No.: PCT/BR2018/050048

§ 371 (c)(1),
(2) Date: Aug. 20, 2020

(87) PCT Pub. No.: WO2019/165516

PCT Pub. Date: Sep. 6, 2019

(65) Prior Publication Data

US 2020/0393194 A1 Dec. 17, 2020

(51) Int. Cl.
*F25D 25/02* (2006.01)
*F25D 23/06* (2006.01)

(52) U.S. Cl.
CPC ..... *F25D 25/025* (2013.01); *F25D 23/067* (2013.01); *F25D 2325/021* (2013.01)

(58) Field of Classification Search
CPC ..... F25D 25/025; F25D 23/067; F25D 2325/021; F25D 17/042
See application file for complete search history.

(56) References Cited

U.S. PATENT DOCUMENTS 2,005,939 A 6/1935 Hibbard, Jr.
2,066,374 A 1/1937 Toulouse
(Continued)

FOREIGN PATENT DOCUMENTS

CN 1837729 9/2006
CN 101614463 12/2009
(Continued)

OTHER PUBLICATIONS

International Search Report and Written Opinion for International Application No. PCT/BR2018/050048, dated Feb. 21, 2020, 11 pages.

(Continued)

*Primary Examiner* — Kimberley S Wright
(74) *Attorney, Agent, or Firm* — Pearne & Gordon LLP

(57) ABSTRACT

A cover is provided for a storage bin of a refrigerator. The cover includes a panel and a communication portion. The panel has an upper surface for storing food items thereon that is substantially planar and substantially horizontal. Moreover, the panel separates an upper space located above the panel from a lower space located below the panel. The communication portion is configured to provide fluid communication between the upper and lower spaces. In particular, the communication portion includes an upward-facing recessed surface, one or more side wall portions that extend above and at least partially bound the recessed surface, and a plurality of apertures that extend through the recessed surface and provide fluid communication between the upper space and lower space. The recessed surface and the one or more side wall portions collectively define a recess. Optionally, a wine rack is provided.

19 Claims, 20 Drawing Sheets

(56) References Cited

U.S. PATENT DOCUMENTS

| | | | | |
|---|---|---|---|---|
| 2,855,262 | A | 10/1958 | Sharpe | |
| 3,102,499 | A | 9/1963 | Shelor | |
| 3,352,431 | A | 11/1967 | Smith | |
| 4,013,434 | A | 3/1977 | Kronenberger et al. | |
| 4,528,825 | A | 7/1985 | Khan | |
| 4,557,118 | A | 12/1985 | Pink et al. | |
| 4,775,201 | A | 10/1988 | Thomson | |
| 4,788,832 | A | 12/1988 | Aoki et al. | |
| 4,960,308 | A | 10/1990 | Donaghy | |
| 5,406,894 | A | 4/1995 | Herrmann et al. | |
| 5,735,589 | A | 4/1998 | Herrmann et al. | |
| 5,813,741 | A | 9/1998 | Fish et al. | |
| 5,918,480 | A | 7/1999 | Nagata et al. | |
| 5,947,574 | A | 9/1999 | Avendano | |
| 6,345,579 | B1 | 2/2002 | Zaturensky | |
| 6,367,276 | B1 | 4/2002 | Kim et al. | |
| 6,520,353 | B2 | 2/2003 | Fulbright | |
| 6,625,991 | B1 | 9/2003 | Clark | |
| 6,978,975 | B1 | 12/2005 | Magnusson | |
| 6,997,531 | B2 | 2/2006 | Kim et al. | |
| 7,063,219 | B2 | 6/2006 | Fann et al. | |
| 7,086,544 | B1 | 8/2006 | Doench | |
| 7,104,411 | B2 | 9/2006 | Magnusson et al. | |
| 7,237,855 | B2 | 7/2007 | Vardon | |
| 7,300,121 | B2 | 11/2007 | Diebold et al. | |
| 7,300,122 | B2 | 11/2007 | Vardon | |
| 7,316,326 | B2 | 1/2008 | Kim et al. | |
| 7,338,142 | B2 | 3/2008 | Nii et al. | |
| 7,363,773 | B2 | 4/2008 | Lee et al. | |
| 7,618,103 | B2 | 11/2009 | Kim | |
| 7,624,593 | B2 | 12/2009 | Lee et al. | |
| D612,404 | S | 3/2010 | Picken et al. | |
| 7,731,316 | B2 | 6/2010 | Wing | |
| 7,740,332 | B2 | 6/2010 | Bassi | |
| 7,850,805 | B2 | 12/2010 | Vardon | |
| 7,950,755 | B2 | 5/2011 | Vardon | |
| 8,231,191 | B2 | 7/2012 | Leconte et al. | |
| 8,256,237 | B2 | 9/2012 | Bischofberger et al. | |
| 8,262,177 | B2 | 9/2012 | Picken et al. | |
| 8,622,494 | B2 | 1/2014 | Picken et al. | |
| 8,789,386 | B2 | 7/2014 | Fotiadis et al. | |
| 8,887,519 | B2 | 11/2014 | Sakashita | |
| 8,979,981 | B1 | 3/2015 | Givler | |
| 8,984,900 | B2 | 3/2015 | Jeong et al. | |
| 8,998,177 | B2 | 4/2015 | Wang et al. | |
| 9,127,880 | B2 | 9/2015 | Park et al. | |
| 9,259,088 | B1 | 2/2016 | Mobley et al. | |
| 10,823,490 | B2 * | 11/2020 | Kumar | F25D 25/02 |
| 2003/0080126 | A1 | 5/2003 | Voute et al. | |
| 2006/0097613 | A1 | 5/2006 | Lee et al. | |
| 2006/0250063 | A1 | 11/2006 | Czach et al. | |
| 2007/0035221 | A1 | 2/2007 | Koo | |
| 2007/0176528 | A1 | 8/2007 | Lee et al. | |
| 2009/0217694 | A1 | 9/2009 | Kim et al. | |
| 2014/0300264 | A1 | 10/2014 | Park | |
| 2017/0160005 | A1 | 6/2017 | Park | |
| 2018/0328653 | A1 * | 11/2018 | Alves Ferreira | F25D 25/025 |
| 2019/0113273 | A1 * | 4/2019 | Kumar | F25D 25/02 |
| 2019/0293342 | A1 * | 9/2019 | Butenhoff | B65D 81/24 |
| 2020/0132360 | A1 * | 4/2020 | Kumar | A47B 96/025 |
| 2021/0018257 | A1 * | 1/2021 | Kumar | F25D 25/02 |

FOREIGN PATENT DOCUMENTS

| | | | | |
|---|---|---|---|---|
| CN | 201954911 | | 8/2011 | |
| CN | 102384631 | | 3/2012 | |
| CN | 102494502 | | 6/2012 | |
| CN | 202709627 | | 1/2013 | |
| CN | 202792790 | | 3/2013 | |
| CN | 202792792 | | 3/2013 | |
| CN | 202947418 | | 5/2013 | |
| CN | 103206833 | | 7/2013 | |
| CN | 103542680 | | 1/2014 | |
| CN | 203605626 | | 5/2014 | |
| CN | 205388398 | | 7/2016 | |
| CN | 107504755 | | 12/2017 | |
| CN | 207132627 | U * | 3/2018 | |
| DE | 102009027652 | | 1/2011 | |
| DE | 102010027590 | | 12/2011 | |
| EP | 0917639 | | 5/1999 | |
| EP | 2295906 | | 3/2011 | |
| EP | 2375203 | A2 * | 10/2011 | F25D 25/02 |
| EP | 2662648 | | 11/2013 | |
| EP | 2840337 | | 2/2015 | |
| JP | 2000-074555 | | 3/2000 | |
| KR | 20030061668 | A | 7/2003 | |
| WO | 9805910 | | 2/1998 | |
| WO | 2011006766 | | 1/2011 | |
| WO | 2011076653 | | 6/2011 | |
| WO | 2011076833 | | 6/2011 | |
| WO | 2012022652 | | 2/2012 | |
| WO | 2013127070 | | 9/2013 | |
| WO | 2013177928 | | 12/2013 | |
| WO | 2015086185 | | 6/2015 | |
| WO | 2018113899 | | 6/2018 | |

OTHER PUBLICATIONS

Extended European Search Report for EP18908117, dated May 9, 2022, 13 pages.

* cited by examiner

STORAGE STRUCTURE FOR REFRIGERATOR APPLIANCE

This application is a U.S. National Phase application of PCT International Application No. PCT/BR2018/050048, filed Mar. 2, 2018, which is incorporated by reference herein.

FIELD OF THE INVENTION

This application relates generally to a refrigeration appliance, and more particularly, to storage structure for a refrigeration appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Conventional refrigerator appliances typically include various storage structures for storing food items within their compartment(s). For instance, a refrigerator can include one or more storage bins or shelves for storing food items. A shelf can be mounted within a storage compartment and can provide a flat, level surface for food items to be stored thereon. Meanwhile, a storage bin can be provided within a storage compartment and can define a storage space for food items to be stored within. In some examples, the storage bin can be slidably coupled to the storage compartment to facilitate access to the storage space within the bin. Also in some examples, a cover can be provided to help establish a semi-sealed environment within the storage bin. An object of the present disclosure is to provide improvements to the storage structure(s) of conventional refrigerator appliances.

BRIEF SUMMARY OF THE INVENTION

In accordance with a first aspect, there is provided a cover for a storage bin of a refrigerator. The cover includes a panel and a communication portion. The panel has an upper surface for storing food items thereon that is substantially planar and substantially horizontal. Moreover, the panel separates an upper space located above the panel from a lower space located below the panel. The communication portion is configured to provide fluid communication between the upper space and lower space. In particular, the communication portion includes an upward-facing recessed surface, one or more side wall portions that extend above and at least partially bound the recessed surface, and a plurality of apertures that extend through the recessed surface and provide fluid communication between the upper space and lower space. The recessed surface and the one or more side wall portions collectively define a recess.

In some examples of the first aspect, the cover further includes an insert member that is removably inserted into the recess of the communication portion such that the insert member is flush with a top of the one or more side wall portions. In some examples, the insert member includes a paper-based material. Further in some examples, the insert member comprises a frame portion and a breathable membrane, wherein the frame portion holds and extends at least partially about a perimeter of the breathable membrane. Still further in some examples, the insert member comprises a first member and a second member removably connected to each other. The first member includes a U-shaped upper portion and a plurality of side walls that extend from the upper portion. Moreover, the second member comprises a breathable membrane and a frame portion that holds and extends at least partially about a perimeter of the breathable membrane.

Further in some examples of the first aspect, the cover includes a frame that is coupled to the panel and extends at least partially about a perimeter of the panel. In some examples, the frame is integrally formed as a monolithic body and defines the communication portion of the cover. Further in some examples, the upper surface of the panel includes a front edge, a rear edge, a left edge, and a right edge; and the frame includes a front trim member that extends along the front edge, a rear trim member that extends along the rear edge, a left trim member that extends along the left edge, and a right trim member that extends along the right edge. Still further in some examples, the communication portion is defined by one of the left trim member and right trim member of the frame.

Still further in some examples of the first aspect, the cover is arranged in a storage compartment of the refrigerator, above the storage bin.

In accordance with the first aspect, there is provided a refrigerator comprising a storage compartment, at least a storage bin arranged in the storage compartment and the cover arranged above the storage bin.

In accordance with a second aspect, a shelf assembly is provided for storing food items within a cabinet of a refrigerator. The shelf assembly includes a shelf for supporting food items thereon, the shelf including a substantially planar upper surface. The shelf assembly further includes a support unit for supporting the shelf, the support unit including a plurality of support arms that are spaced from and extend substantially parallel to each other. The shelf is coupled to the support unit via a mating assembly and a latching assembly. The mating assembly includes an angular pocket defined by an upper surface and a lower surface that face each other and are arranged at an acute angle relative to each other. The mating assembly further includes a wedge-shaped insertion member that resides within the angular pocket. The latching assembly includes a first latching member and a second latching member that is latched to the first latching member.

In some examples of the second aspect, the angular pocket of the mating assembly is defined by a guide member including an upper wall, a pair of side walls that are spaced from each other and extend downward from the upper wall, and a ramped wall that extends from the upper wall at the acute angle and connects the pair of side walls. In some examples, the upper surface of the angular pocket is defined by the upper wall of the guide member, and the lower surface of the angular pocket is defined by the ramped wall of the guide member.

Further in some examples of the second aspect, the first latching member includes a clip arm having an elongated body and a hook portion that extends from a side of the elongated body; and the second latching member includes a recess that receives the clip arm and a latch that is vertically aligned with the hook portion of the clip arm and inhibits vertical movement of clip arm out of the recess. In some examples, the elongated body of the first latching member extends from the upper wall of the guide member, between the pair of side walls.

Still further in some examples of the second aspect, the first latching member and angular pocket are defined by the shelf, and the second latching member and the insertion member are defined by a support arm of the support unit. In some examples, the shelf comprises a panel having an upper surface for storing food items thereon that is substantially planar and substantially horizontal. Moreover, the shelf comprises a frame that is coupled to the panel and extends at least partially about a perimeter of the panel. The frame is integrally formed as a monolithic body and defines the first latching member and angular pocket.

Still yet further in some examples of the second aspect, the shelf assembly is mounted within the cabinet of the refrigerator.

In accordance with the second aspect, there is provided a refrigerator comprising a cabinet and the shelf assembly is mounted within the cabinet for storing food items Further in some examples of the second aspect, a method of assembling the shelf assembly within the cabinet of the refrigerator incudes the steps of attaching the support unit to a wall of the refrigerator such that the plurality of support arms extend substantially horizontal from the wall; inserting the insertion member of the mating assembly into the angular pocket while the upper surface of the shelf is angled relative to horizontal; and then tilting the shelf such that the upper surface of the shelf assumes a substantially horizontal orientation and the first latching member and second latching member of the latching assembly latch to each other.

In accordance with a third aspect, a shelf assembly is provided for storing food items within a cabinet of a refrigerator. The shelf assembly includes a shelf for supporting food items thereon, the shelf having an upper surface being substantially planar and substantially horizontal. The shelf assembly further includes a wine rack coupled to the shelf that is adjustable between a stored configuration and a deployed configuration. The wine rack includes a front wire, a rear wire, and a connection arm. The front wire has a plurality of undulation portions and is rotatably coupled to the shelf such that the front wire is rotatable about a front rotational axis. The rear wire is rotatably coupled to the shelf such that the rear wire is rotatable about a rear rotational axis that is substantially parallel to the front rotational axis. Moreover, the rear wire includes a plurality of stop portions, each stop portion being rearwardly aligned with an associated undulation portion of the front wire. The connection arm is pivotally coupled to the front wire and the rear wire and includes a linkage member having a front end and a rear end, a front bushing provided at the front end of the linkage member that pivotally engages the front wire, a rear bushing provided at the rear end of the linkage member that pivotally engages the rear wire, and a handle that extends from the front end of the linkage member. The connection arm is pivotally coupled to the front wire and the rear wire such that the front wire and rear wire rotate respectively about the front rotational axis and rear rotational axis in unison.

In some examples of the third aspect, the linkage member of the connection arm includes a longitudinal axis that is substantially horizontal and substantially perpendicular to the first rotational axis and second rotational axis; and the handle of the connection arm extends from the front end of the linkage member in a direction that is transverse to the longitudinal axis.

Further in some examples of the third aspect, the front bushing of the connection includes a first pair of attachments arms that wrap around the front wire; and the rear bushing of the connection arm includes a second pair of attachments arms that wrap around the rear wire.

Still further in some examples of the third aspect, the rear wire includes a U-shaped portion having a linear segment, a first arm segment, and a second arm segment, the first arm segment and second arm segment extending from opposite ends of the linear segment; and the stop portions of the rear wire are defined by the linear segment of the U-shaped portion. In some examples, the undulations portions of the front wire extend along a common plane and the U-shaped portion is arranged substantially parallel to the plane. Further in some examples, the wine rack is adjusted between its stored configuration and deployed configuration by rotating the front wire and the rear wire respectively about the first rotational axis and second rotational axis. In the deployed configuration, the front wire and the rear wire are arranged respectively about the first rotational axis and second rotational axis such that the undulation portions of the front wire and the U-shaped portion of the rear wire are arranged substantially vertical. Also in the deployed configuration, the undulation portions of the front wire extend below the stop portions of the rear wire.

DESCRIPTION OF EXAMPLE EMBODIMENTS

Figure 1:
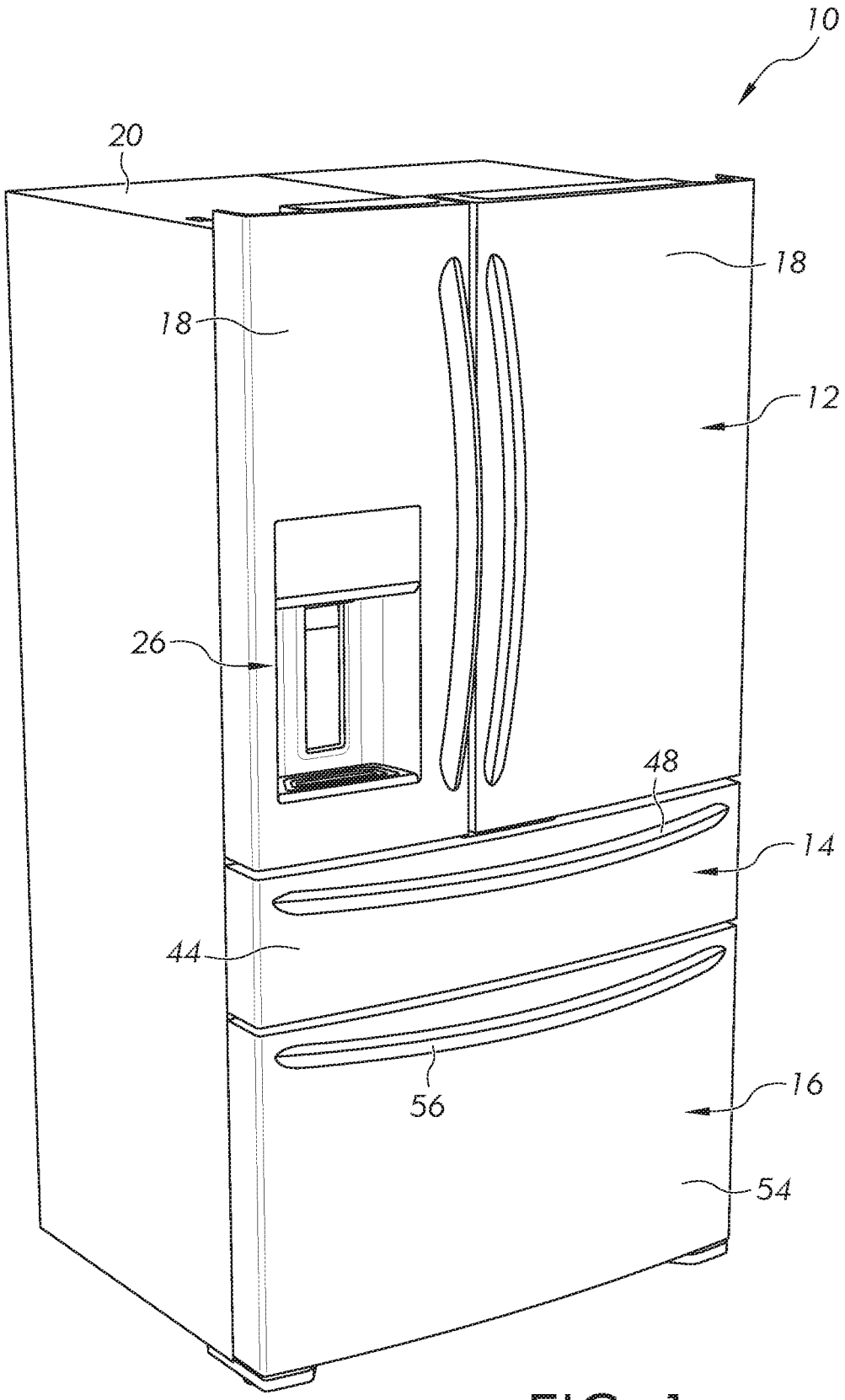
FIG. 1 is a front perspective view of a household French Door Bottom Mount refrigerator showing doors of the refrigerator in a closed position.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 12 disposed vertically above a variable climate zone (VCZ) compartment 14 and a freezer compartment 16.

Two doors 18 shown in FIG. 1 are pivotally coupled to a cabinet 20 of the refrigerator 10 to restrict and grant access to the fresh food compartment 12. The doors 18 are French-type doors that collectively span the entire lateral distance of the entrance to the fresh food compartment 12 to enclose the fresh food compartment 12. A center flip mullion 22 (FIG. 2) is pivotally coupled to at least one of the doors 18 to establish a surface against which a seal provided to the other one of the doors 18 can seal the entrance to the fresh food compartment 12 at a location between opposing side surfaces 24 (FIG. 2) of the doors 18. The mullion 22 can be pivotally coupled to the door 18 to pivot between a first orientation that is substantially parallel to a planar surface of the door 18 when the door 18 is closed, and a different orientation when the door 18 is opened. The externally-exposed surface of the center mullion 22 is substantially parallel to the door 18 when the center mullion 22 is in the first orientation, and forms an angle other than parallel relative to the door 18 when the center mullion 22 is in the second orientation. In the embodiment shown in FIG. 1, the seal and the externally-exposed surface of the mullion 22 cooperate at a position offset from a centerline midway between the lateral sides of the fresh food compartment 12. It is contemplate that the seal and the externally-exposed surface of the mullion 22 can cooperate approximately midway between the lateral sides of the fresh food compartment 12.

A dispenser 26 (FIG. 1) for dispensing at least ice pieces, and optionally water, can be provided on an exterior of one of the doors 18 that restricts access to the fresh food compartment 12. The dispenser 26 includes a lever, switch, proximity sensor or other device that a user can interact with to cause frozen ice pieces to be dispensed from an ice bin (not shown) of an ice maker 28 disposed within the fresh food compartment 12. Ice pieces from the ice maker 28 can exit the ice maker 28 through an aperture (not shown) and be delivered to the dispenser 26 via an ice chute (not shown), which extends at least partially through the door 18 between the dispenser 26 and the ice maker 28.

The refrigerator 10 includes an interior liner 30 (FIG. 2) that defines the fresh food compartment 12. In particular, the inner liner 30 can define a bottom wall 32, a top wall 34, a rear wall 36, a left side wall 38, and a right side wall 40 of the fresh food compartment 12. The fresh food compartment 12 is located in the upper portion of the refrigerator 10 in this example and serves to minimize spoiling of articles of food stored therein. The fresh food compartment 12 accomplishes this by maintaining the temperature in the fresh food compartment 12 at a cool temperature that is typically above 0° C., so as not to freeze the articles of food in the fresh food compartment 12. It is contemplated that the cool temperature preferably is between 0° C. and 10° C., more preferably between 0° C. and 5° C. and even more preferably between 0.25° C. and 4.5° C. A separate fresh food evaporator (not shown) is dedicated to separately maintaining the temperature within the fresh food compartment 12 independent of the freezer compartment 16. According to an embodiment, the temperature in the fresh food compartment 12 can be maintained at a cool temperature within a close tolerance of a range between 0° C. and 4.5° C., including any subranges and any individual temperatures falling with that range. For example, other embodiments can optionally maintain the cool temperature within the fresh food compartment 12 within a reasonably close tolerance of a temperature between 0.25° C. and 4° C.

Figure 2:
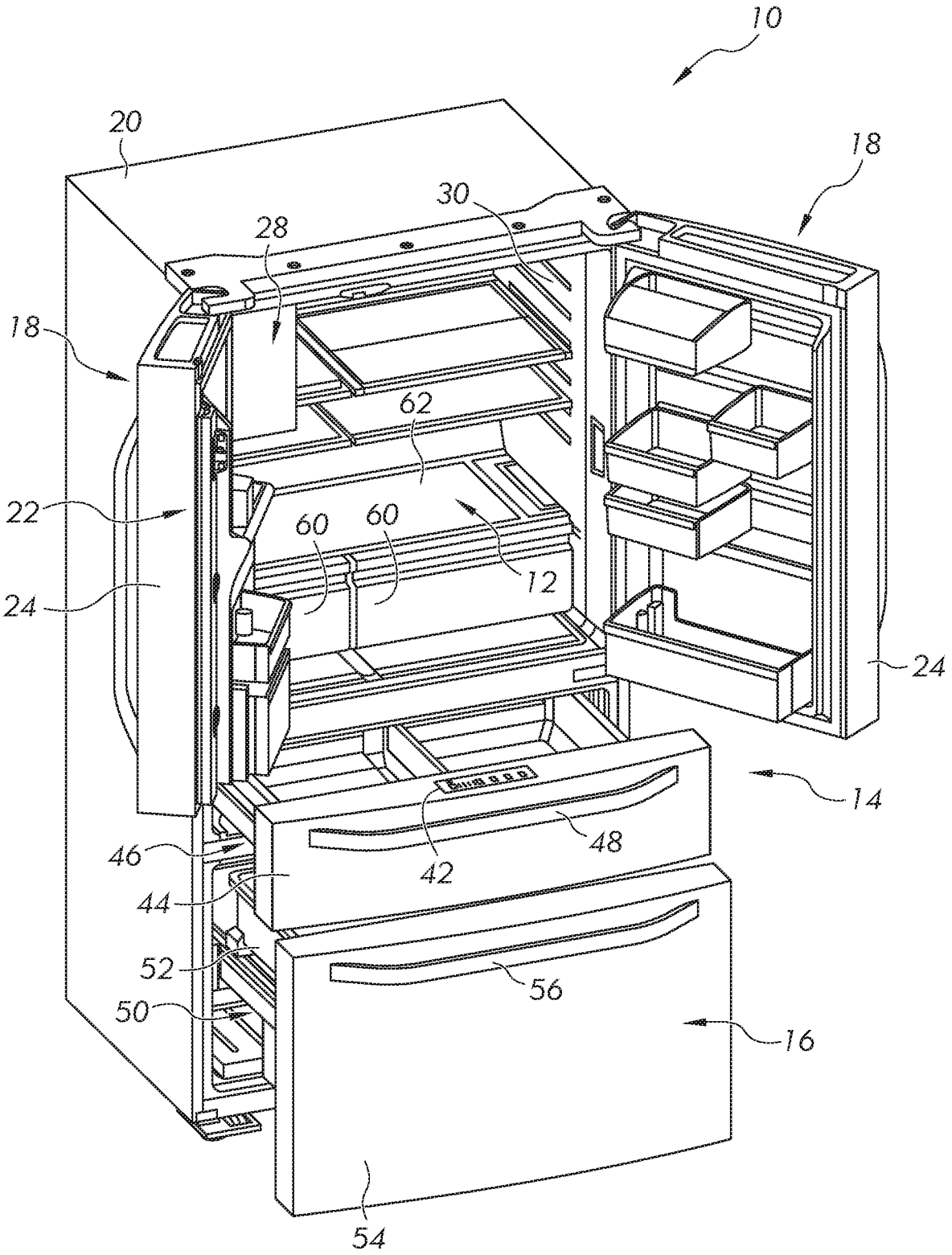
FIG. 2 is a front perspective view of the refrigerator showing doors of a fresh food compartment and drawers of a freezer compartment and a variable climate zone compartment in an opened position.

Referring to FIG. 2, the VCZ compartment 14 is arranged vertically beneath the fresh food compartment 12. The VCZ compartment 14 can operate at different user-selectable temperatures as either a refrigerator (i.e., above-freezing) or a freezer (i.e., below-freezing). A control unit or user interface 42 is disposed on a front panel 44 of the VCZ compartment 14 to allow a user the ability to selectively operate the VCZ compartment 14 at one of a variety of temperatures including both true fresh food and freezing temperatures, for example, −18° C., −12° C., −2 C, 0° C. and +4° C. The VCZ compartment 14 is fluidly in communication with the freezer compartment 16 and may include a heater (not shown) for heating the air conveyed to the VCZ compartment 14, if desired. The front panel 44 is part of a drawer assembly 46 that can be withdrawn from the VCZ compartment 14 to grant a user access to food items stored in the VCZ compartment 14. A handle 48 can be coupled to the front panel 44 to allow a user to pull the drawer assembly 46 to an extended position and thereby access the food items.

The freezer compartment 16 is arranged vertically beneath the VCZ compartment 14. A drawer assembly 50 including one or more freezer baskets 52 can be withdrawn from the freezer compartment 16 to grant a user access to food items stored in the freezer compartment 16. The drawer assembly can be coupled to a freezer door 54 that includes a handle 56. When a user grasps the handle 56 and pulls the freezer door 54 open, at least one or more of the freezer baskets 52 is caused to be at least partially withdrawn from the freezer compartment 16.

The freezer compartment 16 is used to freeze and/or maintain articles of food stored in the freezer compartment 16 in a frozen condition. For this purpose, the freezer compartment 16 is in thermal communication with a freezer evaporator (not shown) that removes thermal energy from the freezer compartment 16 to maintain the temperature therein at a temperature of 0° C. or less during operation of the refrigerator 10, preferably between 0° C. and −50° C., more preferably between 0° C. and −30° C. and even more preferably between 0° C. and −20° C. The freezer compartment 16 is also in communication with the VCZ compartment 14 such that a portion of the cooling air supplied to the freezer compartment 16 can be selectively supplied to the VCZ compartment 14.

As shown in FIG. 2, the refrigerator 10 can include one or more storage bins 60 arranged within a storage compartment (e.g., the fresh food compartment 12) of the refrigerator 10. Moreover, the refrigerator 10 can include a cover 62 that is configured to cover the one or more storage bins 60. In the illustrated embodiment, the refrigerator 10 includes two storage bins 60 arranged side-by-side within its fresh food compartment 12 such that the storage bins 60 collectively span across the width of the fresh food compartment 12. Moreover, the cover 62 spans across the width of the fresh food compartment 12 and is configured to cover both storage bins 60. However, in other examples, the cover 62 may only cover a single storage bin 60. Moreover, in some examples, the cover 62 may cover more than two storage bins 60. The cover 62 may cover any number of storage bins 60 without departing from the scope of the invention.

Figure 3:
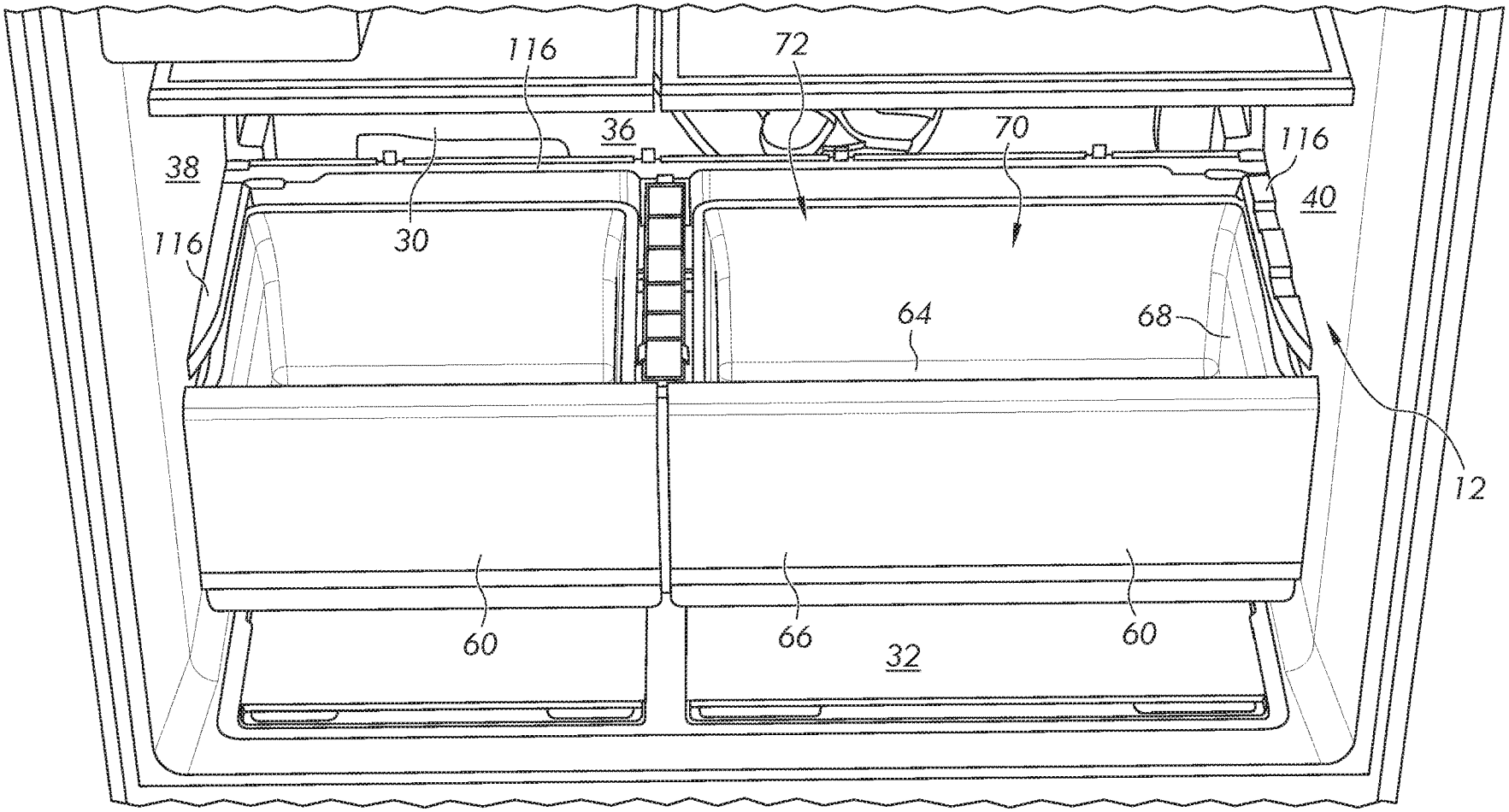
FIG. 3 is a perspective view of storage bins within fresh food compartment of the refrigerator.

FIG. 3 shows the storage bins 60 with the cover 62 removed for ease of illustration. As can be seen in FIG. 3, each bin 60 can comprise a bottom wall 64, a front wall 66, and a plurality of side walls 68 that collectively define a storage space 70 within the bin 60 for storing food items such as, for example, vegetables, deli meats, cheeses, etc. The side walls 68 of each bin 60 define an opening 72 that permits access to its storage space 70 from above the bin 60.

Each bin 60 can be integrally formed with the interior liner 30 of the refrigerator 10, or can be a separately formed and placed within the fresh food compartment 12. Moreover, each bin 60 can be fixed within the fresh food compartment 12 or movably coupled to facilitate access to the storage space 70 within the bin 60. For example, in the illustrated embodiment, each bin 60 is a plastic bin that is separately formed as a drawer via a molding process and then slidably coupled within the fresh food compartment 12 such that the bin 60 can slide along a front-to-rear direction of the refrigerator 10. In this manner, each bin 60 can slide between a retracted position in which the bin 60 is closest to the rear wall 36 of the fresh food compartment 12, and an extended position in which the bin 60 is drawn away from the rear wall 36.

Figure 4:
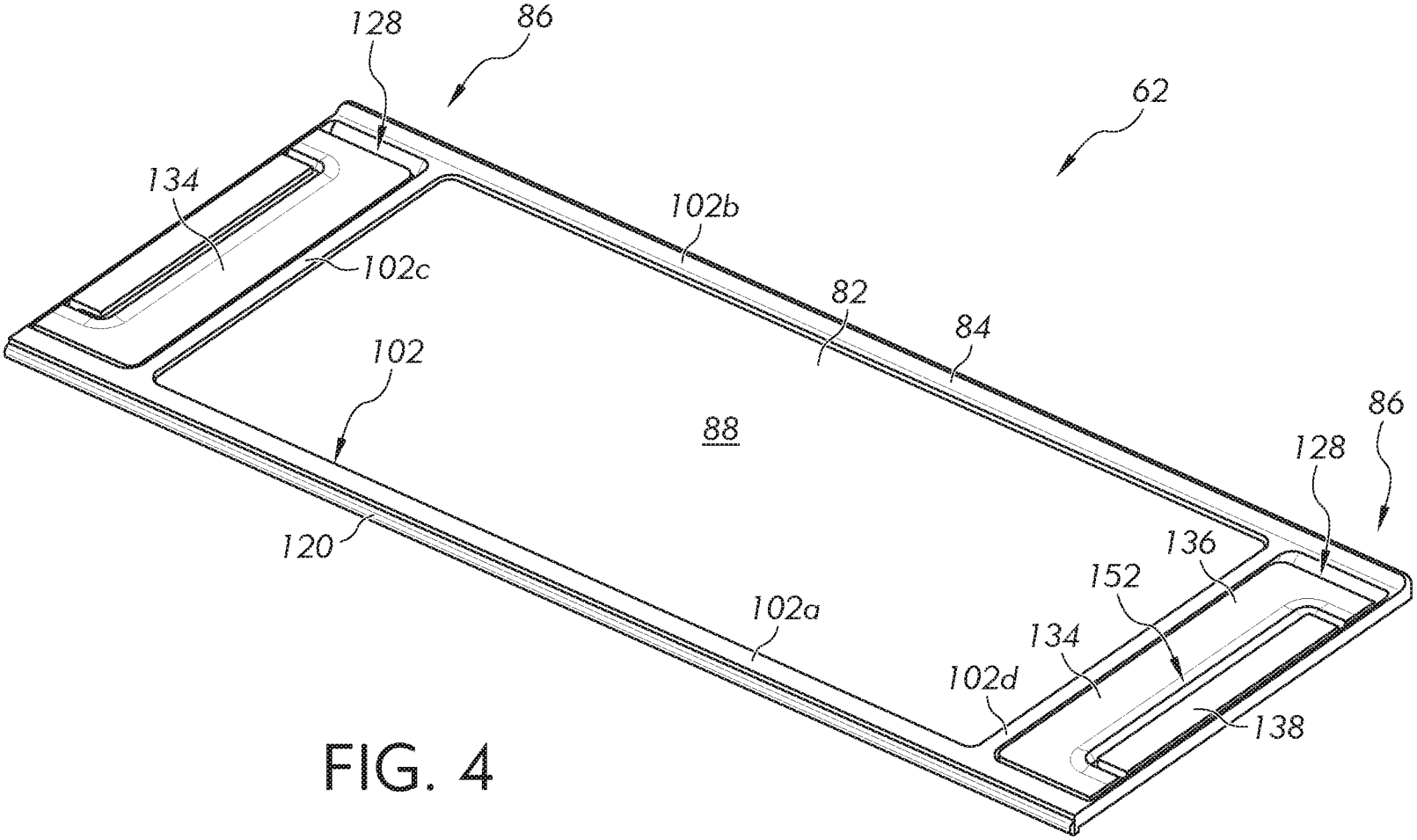
FIG. 4 is a perspective view of a cover for the storage bins.

Turning to FIGS. 4-14, the cover 62 will now be described in further detail. As can be seen in FIG. 4, the cover 62 can include a panel 82 and a frame 84 that is coupled to the panel 82 and extends at least partially about a perimeter of the panel 82. Moreover, as will be described further below, the cover 62 can include one or more communication portions 86 that are configured to provide controlled (e.g., restricted) fluid communication between spaces above and below the cover 62.

Figure 5:
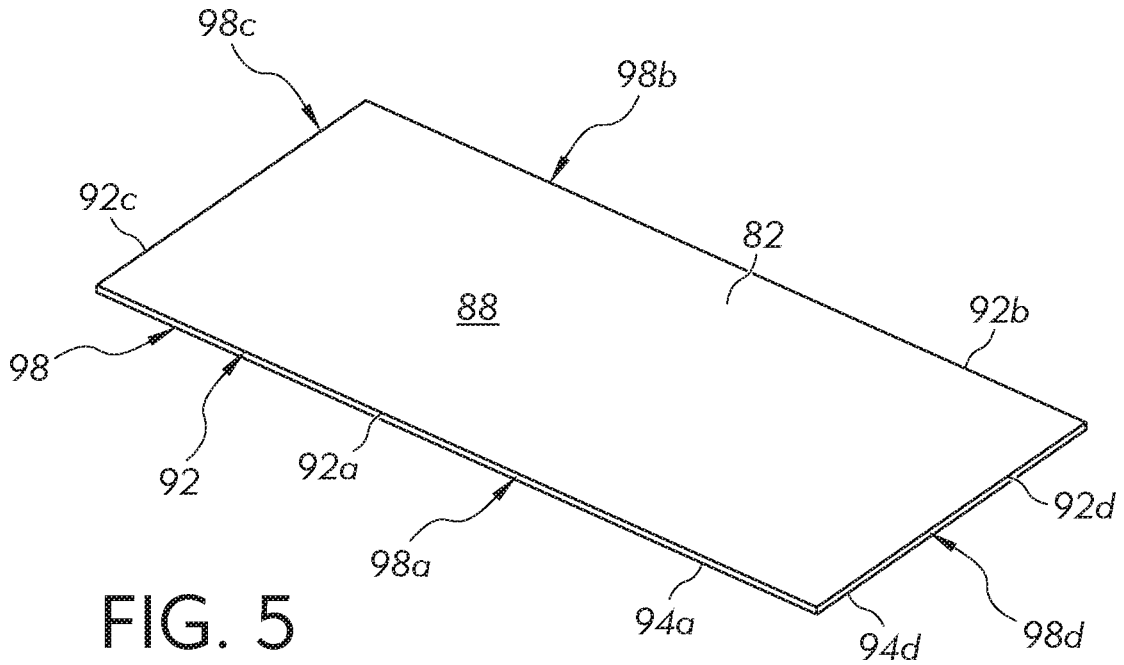
FIG. 5 is an upper perspective view of a panel for the cover.
Figure 6:
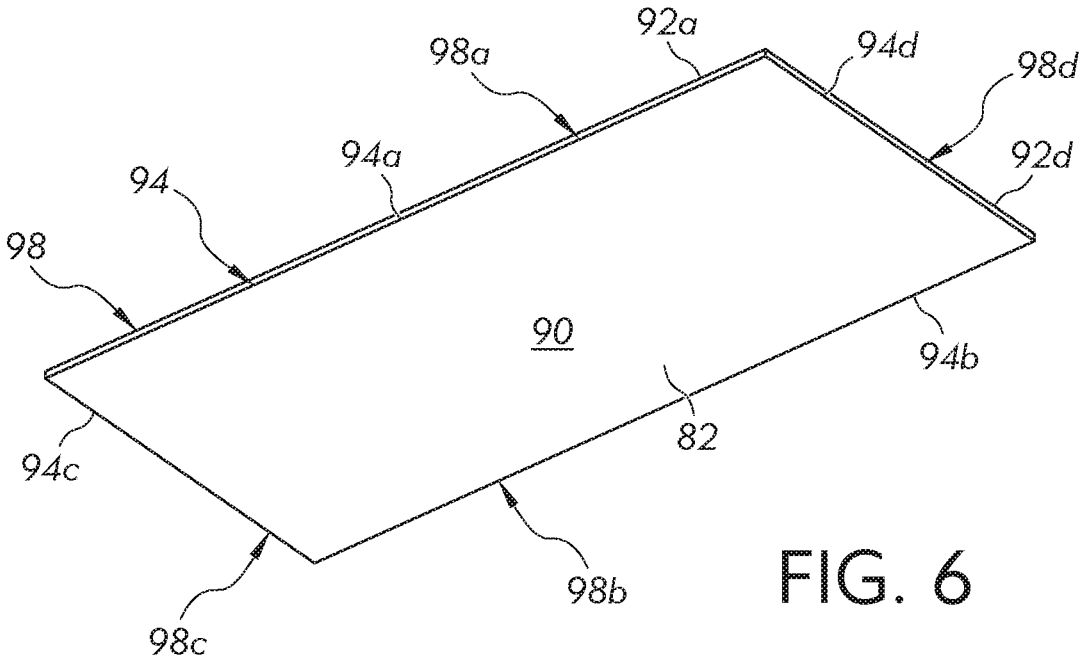
FIG. 6 is a lower perspective view of the panel for the cover.

FIGS. 5 & 6 illustrate the panel 82 in isolation. In particular, FIG. 5 is a top perspective view of the panel 82, while FIG. 6 is a bottom perspective view of the panel 82. As can be seen in FIGS. 5 & 6, the panel 82 can include an upper surface 88 and a lower surface 90 spaced from the upper surface 88 that faces an opposite direction from the upper surface 88.

The upper surface 88 of the panel 82 can comprise a shape defined by a plurality of edges 92. For instance, as shown in FIG. 5, the upper surface 88 in the illustrated embodiment comprises a substantially rectangular shape defined by a front edge 92*a*, a rear edge 92*b*, a left edge 92*c*, and a right edge 92*d*. The front edge 92*a* and rear edge 92*b* are spaced from and extend substantially parallel to each other along a first direction. Meanwhile, the left edge 92*c* and the right edge 92*d* are spaced from and extend substantially parallel to each other along a second direction that is substantially perpendicular to the first direction. However, the upper surface 88 may comprise other shapes defined by edges of different configurations in other embodiments. Moreover, although the edges 92 in the present embodiment are all substantially straight, one or more of the edges 92 may be curved in other embodiments.

The lower surface 90 of the panel 82 can have a substantially similar shape as the upper surface 88 that is similarly defined by a plurality of edges 94 (see FIG. 6). Each edge 94 of the lower surface 90 can be spaced from and extend substantially parallel to a corresponding edge 92 of the upper surface 88. For example, the lower surface 90 in the present embodiment has a front edge 94*a* that is spaced from and extends substantially parallel to the front edge 92*a* of the upper surface 88, a rear edge 94*b* that is spaced from and extends substantially parallel to the rear edge 92*b* of the upper surface 88, a left edge 94*c* that is spaced from and extends substantially parallel to the left edge 92*c* of the upper surface 88, and a right edge 94*d* that is spaced from and extends substantially parallel to the right edge 92*d* of the upper surface 88.

The panel 82 can further include a plurality of edge surfaces 98 that extend between and abut corresponding edges 92, 94 of the upper surface 88 and lower surface 90. For example, the panel 82 in the present embodiment includes a front edge surface 98*a* that extends between and abuts the front edge 92*a* of the upper surface 88 and the front edge 94*a* of the lower surface 90, a rear edge surface 98*b* that extends between and abuts the rear edge 92*b* of the upper surface 88 and the rear edge 94*b* of the lower surface 90, a left edge surface 98*c* that extends between and abuts the left edge 92*c* of the upper surface 88 and the left edge 94*c* of the lower surface 90, and a right edge surface 98*d* that extends between and abuts the right edge 92*d* of the upper surface 88 and the right edge 94*d* of the lower surface 90.

The panel 82 described above can comprise glass or some other material such as, for example, molded plastic. For ease of illustration, the drawings in the present disclosure show the panel 82 as an opaque structure. However, it is to be appreciated that the panel 82 may be transparent or translucent in some embodiments.

Figure 7:
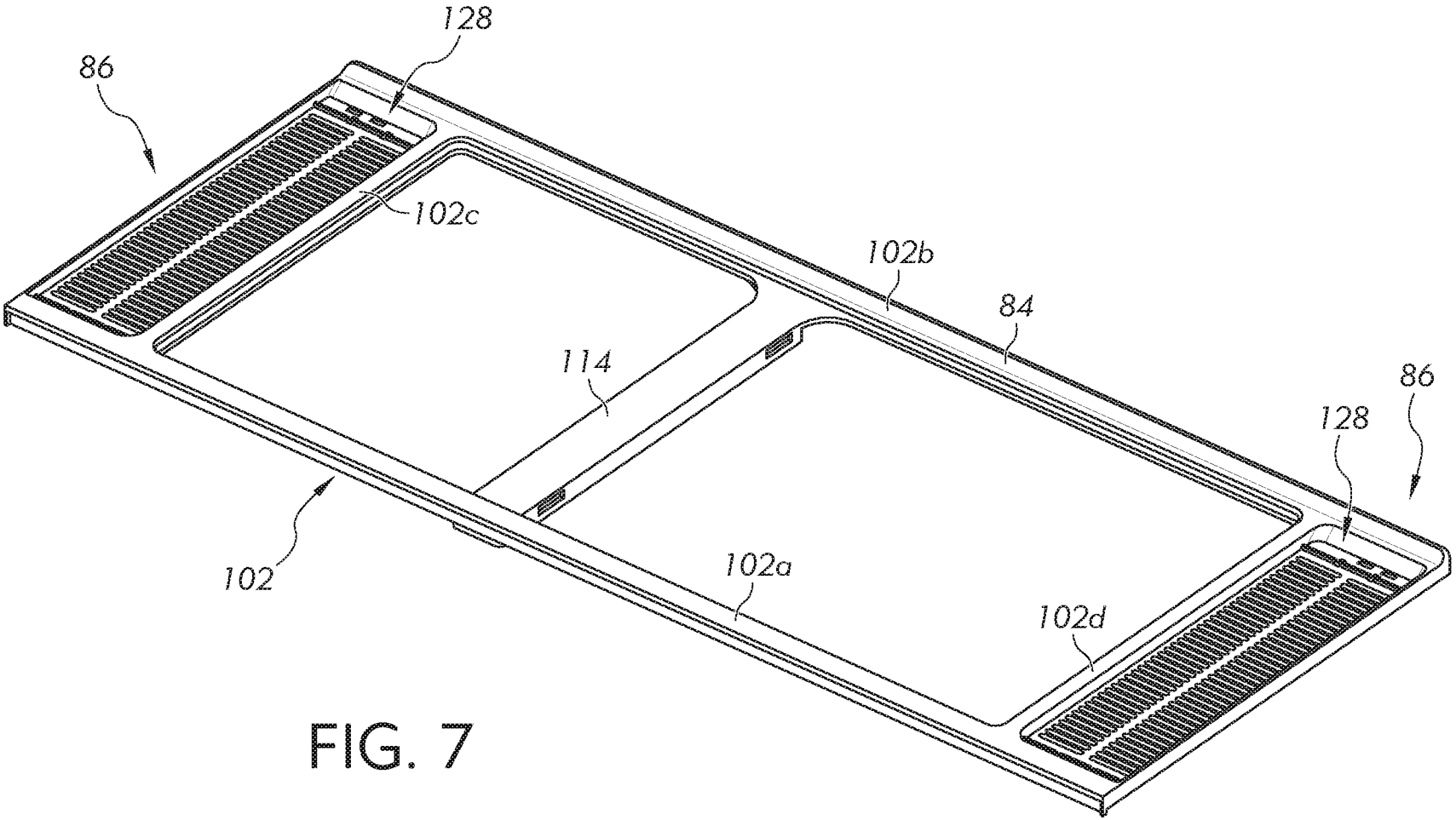
FIG. 7 is a perspective view of a frame for the cover.
Figure 8:
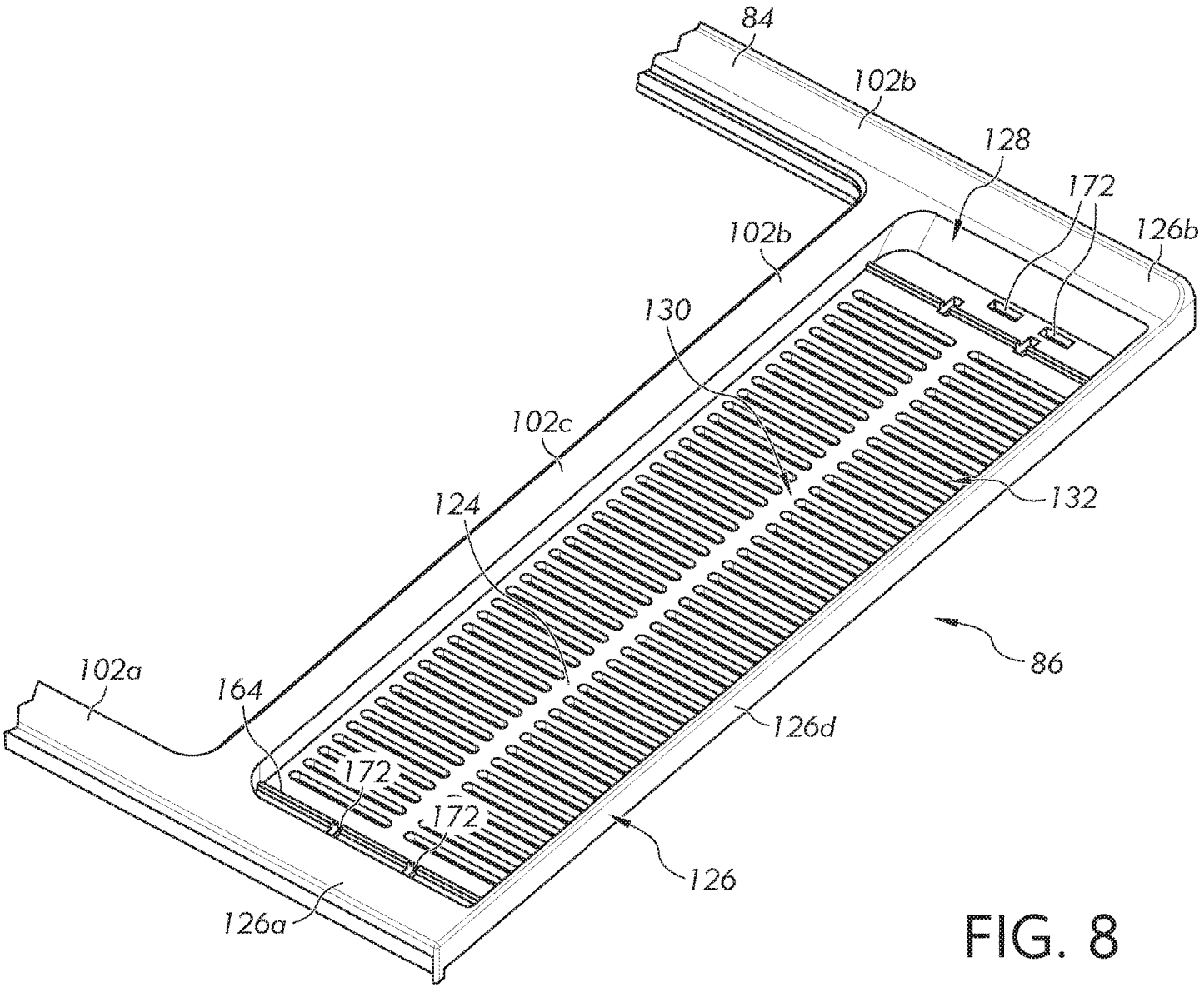
FIG. 8 is a close-up perspective view of a communication portion of the frame.

The frame 84 of the cover 62 will now be described in further detail, with reference to FIGS. 7-9. FIGS. 7 & 8 show perspective views of the frame 84 in isolation, while FIG. 9 is a cross-section view of the cover 62 showing the frame 84 as coupled to the panel 82.

Figure 9:
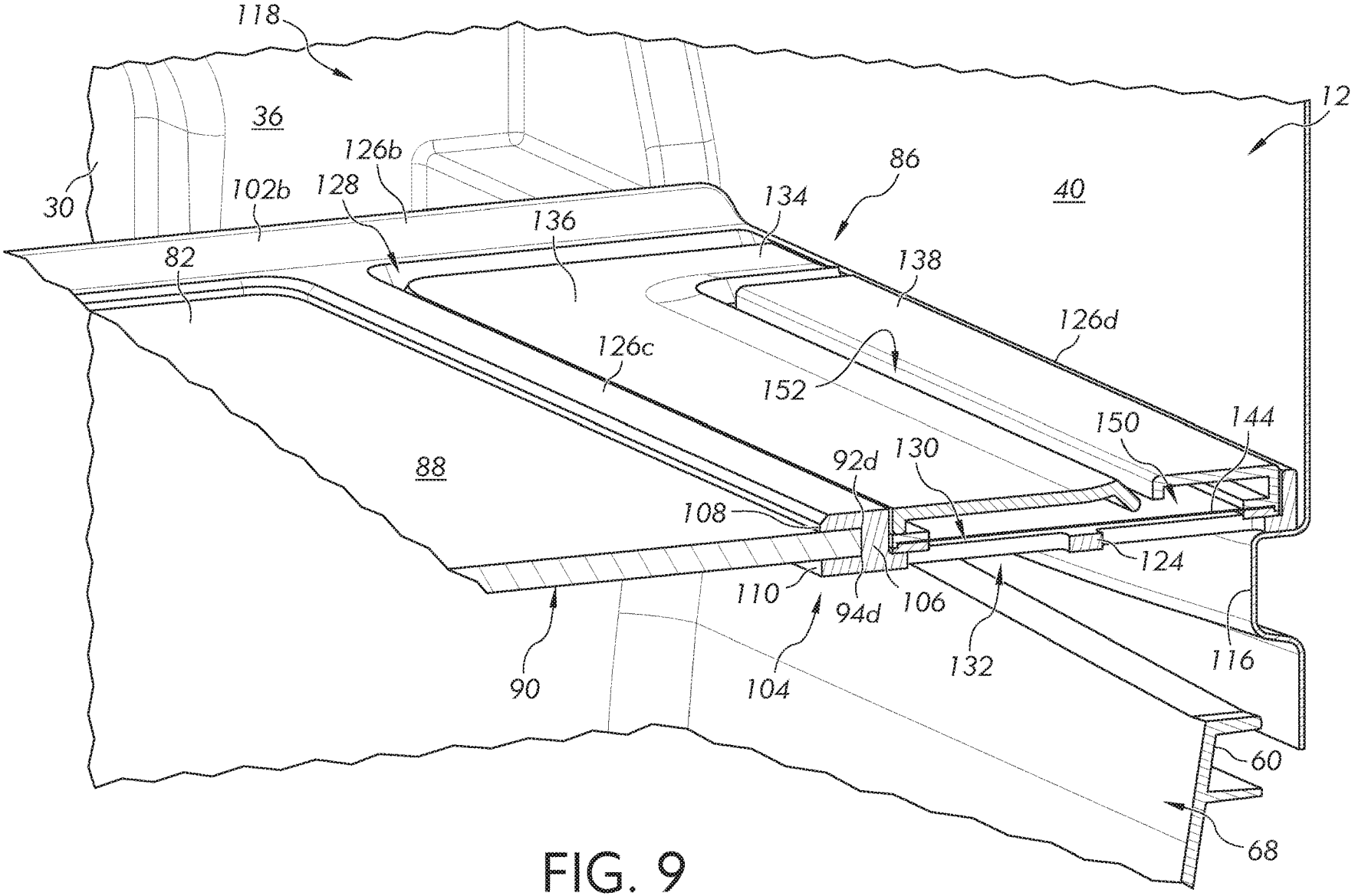
FIG. 9 is a cross-section view of the refrigerator showing the cover mounted above a storage bin.
Figure 10:
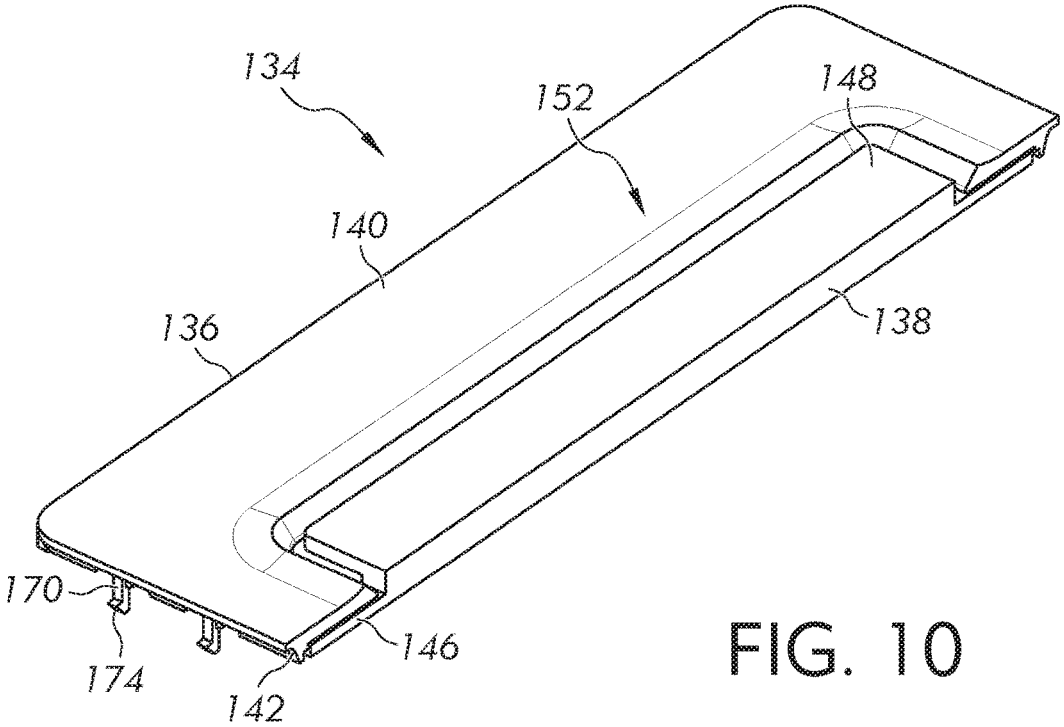
FIG. 10 is an upper perspective view of a first embodiment of an insert member for the cover.
Figure 11:
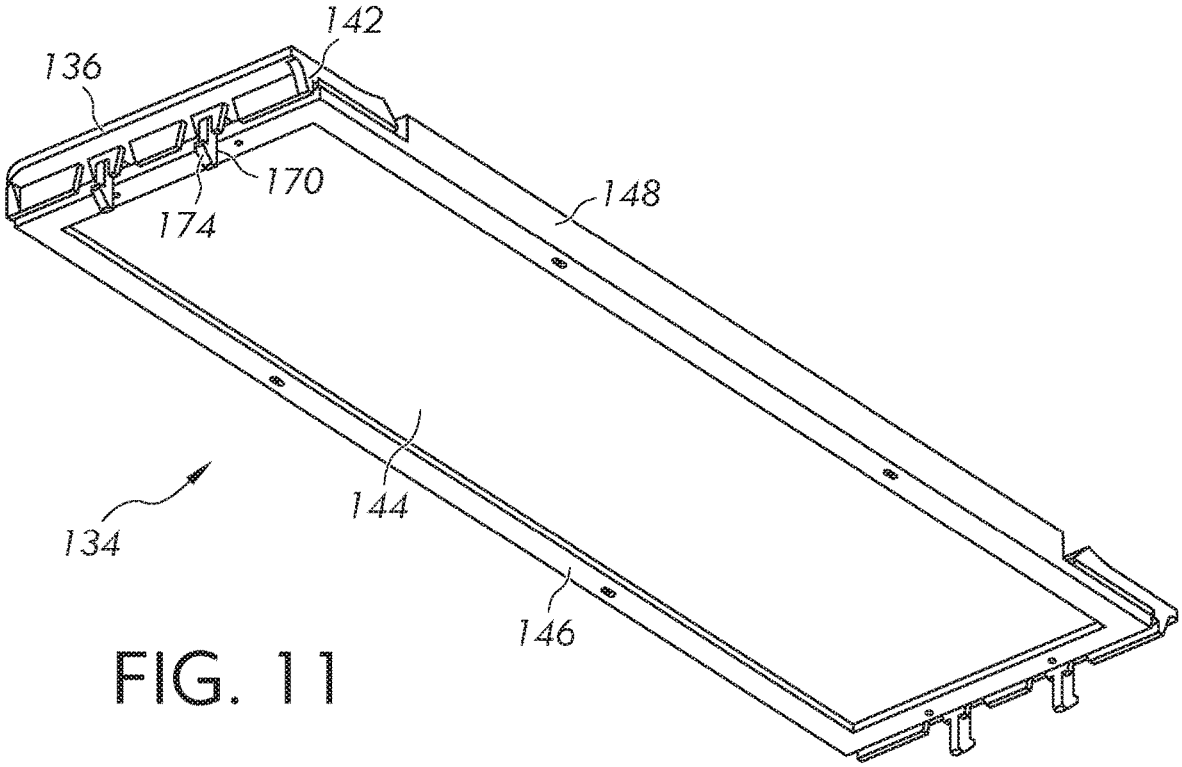
FIG. 11 is a lower perspective view of the first embodiment of the insert member.
Figure 12:
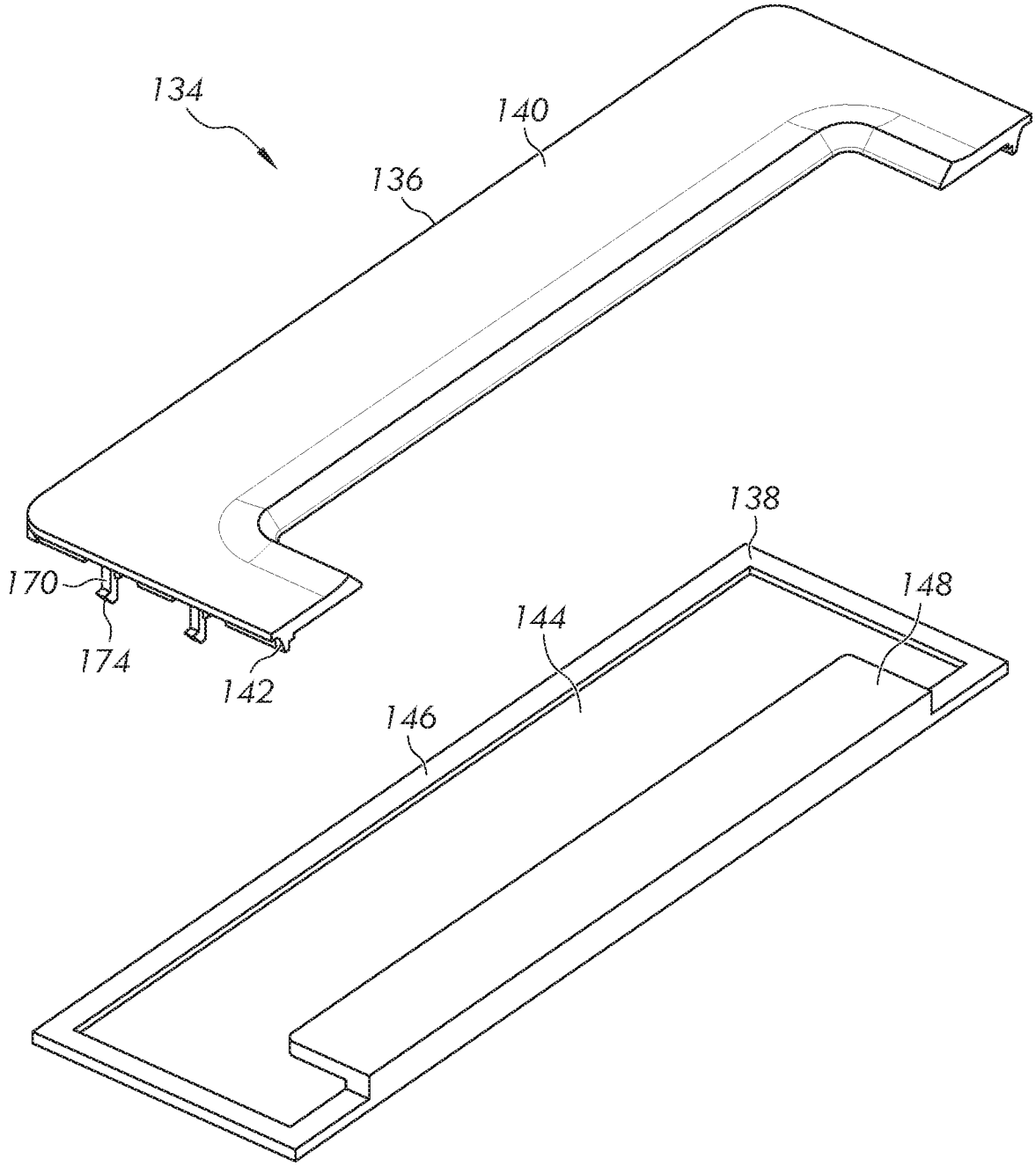
FIG. 12 is an exploded view of the first embodiment of the insert member.

As shown in FIGS. 7-9, the frame 84 can include one or more trim members 102 that are configured to extend along one more edges 92, 94 of the panel 82 described above. For instance, in the illustrated embodiment, the frame 84 includes a front trim member 102*a* that is configured to extend along the front edges 92*a*, 94*a* of the panel 82, a rear trim member 102*b* that is configured to extend along the rear edges 92*b*, 94*b* of the panel 82, a left trim member 102*c* that is configured to extend along the left edges 92*c*, 94*c* of the panel 82, and a right trim member 102*d* that is configured to extend along the right edges 92*d*, 94*d* of the panel 82.

Each trim member 102 can have a U-shaped portion 104 (see e.g., FIG. 9) that wraps around its associated edges 92, 94. In particular, the U-shaped portion 104 can include an outer portion 106, an upper portion 108 that extends inward (i.e., toward a center of the panel 82) from the outer portion 106 above the upper surface 88 of the panel 82, and a lower portion 110 that extends inward (i.e., toward a center of the panel 82) from the outer portion 106 below the lower surface 90 of the panel 82.

In some examples, the frame 84 can include an intermediate member 114 (see e.g., FIG. 7) that extends substantially parallel to the left and right trim members 102*c*, 102*d* and is located between left and right trim members 102*c*, 102*d*. The intermediate member 114 can be disposed below the lower surface 90 of the panel 82 and can connect with the front trim member 102*a* and the rear trim member 102*b*. In this manner, the intermediate member 114 can improve the stability of the frame 84 and provide support for the panel 82 above the intermediate member 114. Moreover, in embodiments in which the cover 62 extends over two storage bins 60 arranged side-by-side, the intermediate member 114 can be arranged between the two storage bins 60 and act as a divider that inhibits fluid communication between the storage spaces 70 of the bins 60.

The frame 84 described above can comprise a rigid plastic and can be integrally formed as a monolithic body via an injection molding process. In particular, the frame 84 can be overmolded onto the panel 82 such that its trim member(s) 102 wrap around their associated edges 92, 94. However, the frame 84 may comprise other materials and/or may be formed by other processes in other examples. Indeed, in some examples, the frame 84 may be integrally formed with the panel 82 such that the frame 84 and panel 82 are part of a single body. In other examples, the frame 84 may include separate elements (e.g., separate trim members 102) that are separately attached to each other to form the frame 84. Moreover, in some examples, cover 62 may not include the frame 84 and may have a frameless panel 82.

The cover 62 can be mounted within the fresh food compartment 12 above one or more of the storage bins 60 in a variety of different manners. For example, as shown in FIG. 9, the refrigerator 10 can include one or more support bodies 116 that the cover 62 can be placed on to install the cover 62 within the fresh food compartment 12. Each support body 116 can be integrally formed with the interior liner 30 of the refrigerator 10 or separately formed and attached to the interior liner 30. In other examples, the cover 62 may be placed directly onto a storage bin 60 below and can act as a movable lid for the storage bin 60.

In examples in which a storage bin 60 is slidable between retracted and extended positions, the cover 62 can be mounted such that the cover 62 remains stationary in the fresh food compartment 12 as the storage bin 60 is slid to its extended position. In this manner, the storage space 70 within the storage bin 60 can be made accessible by sliding the storage bin 60 to its extended position. However, in some examples, the cover 62 may be coupled to the storage bin 60 such that the cover 62 translates with the storage bin 60 between its retracted and extended positions. In such examples, the storage space 70 within a storage bin 60 can be made accessible by other means such as, for example, pivoting the cover 62 open or completely removing the cover 62.

The cover 62 is designed such that when mounted within the fresh food compartment 12, the panel 82 of the cover 62 can separate an upper space 118 of the fresh food compartment 12 located above the panel 82 from a lower space (e.g., the storage spaces 70 of the bins 60) located below the panel 82. In this manner, the cover 62 can help isolate the environment within the storage bins 60 from other areas within the fresh food compartment 12. Moreover, the upper surface 88 of the panel 82 can be arranged substantially horizontal to provide a level surface for food items to stored thereon.

In some examples, the cover 62 can include a seal member 120 (see e.g., FIG. 4) that is configured to provide a seal between the cover 62 and a face of the storage bin(s) 60 located below the cover 62. The seal member 120 can be an elongated body comprising a material such as, for example, PTFE, nitrile, neoprene, EPDM rubber, etc. In the illustrated embodiment, the seal member 120 extends along and is attached to the front trim member 102*a* of the frame 84 on a front side of the trim member 102*a*. The seal member 120 is configured to engage (e.g., contact) the front wall 66 of each storage bin 60 when in its retracted position. In this manner, the seal member 120 can provide a seal between the front wall 66 of each storage bin 60 and the front trim member 102*a* of the cover 62 to help establish a semi-sealed environment within the storage bin 60. However, it is to be appreciated that the seal member 120 can comprise other shapes, materials, and/or configurations in other examples to provide a seal between the cover 62 and the storage bin(s) 60.

As noted above, the cover 62 can include one or more communication portions 86 that can provide controlled (e.g., restricted) fluid communication between spaces above and below the cover 62. In particular, each communication portion 86 can be configured to provide controlled fluid communication between the storage space 70 of a storage bin 60 and the upper space 118 of the fresh food compartment 12, as described further below.

More specifically, as shown in FIGS. 7-9, each communication portion 86 can comprise a lower portion 124 and one or more side wall portions 126 that collectively define a recess 128. The lower portion 124 defines an upward-facing recessed surface 130 that is bounded at least partially by the one or more side wall portions 126, which extend above the recessed surface 130. Moreover, the lower portion 124 defines a plurality of apertures 132 that extend through the recessed surface 130 and provide fluid communication therethrough between the storage space 70 of an associated storage bin 60 and the upper space 118 of the fresh food compartment 12.

In the illustrated embodiment, the apertures 132 of each communication portion 86 are elongated along a right-to-left direction of the cover 62, and are arranged in two rows that are aligned along a front-to-rear direction of the cover 62. Also in the illustrated embodiment, each communication portion 86 has a front side wall portion 126*a*, a rear side wall portion 126*b*, a left side wall portion 126*c*, and a right side wall portion 126*d* that completely bound the upper surface 130 of the lower portion 124. The front, left, and right side wall portions 126*a*, 126*c*, 126*d* have substantially vertical surfaces facing the recess 128, while the rear side wall portion 126*b* has a ramped surface that slopes upward along a front-to-rear direction of the cover 62. However, the apertures 132 may comprise other shapes and/or alignments in some examples, and the surfaces of the side wall portions 126 can have different orientations and configurations in some examples. Moreover, each communication portion 86 may have fewer side wall portions 126 in some examples, and the recessed surface 130 may only be partially bounded by one or more side wall portions 126 in some examples.

Further in the illustrated embodiment, each communication portion 86 is defined by (e.g., an integral component of) a trim member 102 of the frame 84 described above. In particular, the cover 62 includes one communication portion 86 defined by the left trim member 102*c* that provides fluid communication for the left storage bin 60, and another communication portion 86 defined by the right trim member 102*d* that provides fluid communication for the right storage bin 60. However, the front trim member 102*a* and/or rear trim member 102*b* may define a communication portion 86 in some examples. Moreover, in some examples, one or more communication portions 86 can be defined by structure other than the frame 84 such as, for example, the panel 82. The cover 62 can include any number of communication portions 86, defined by any type of structure, and provided at any location along the cover 62 without departing from the scope of the invention.

Figure 13:
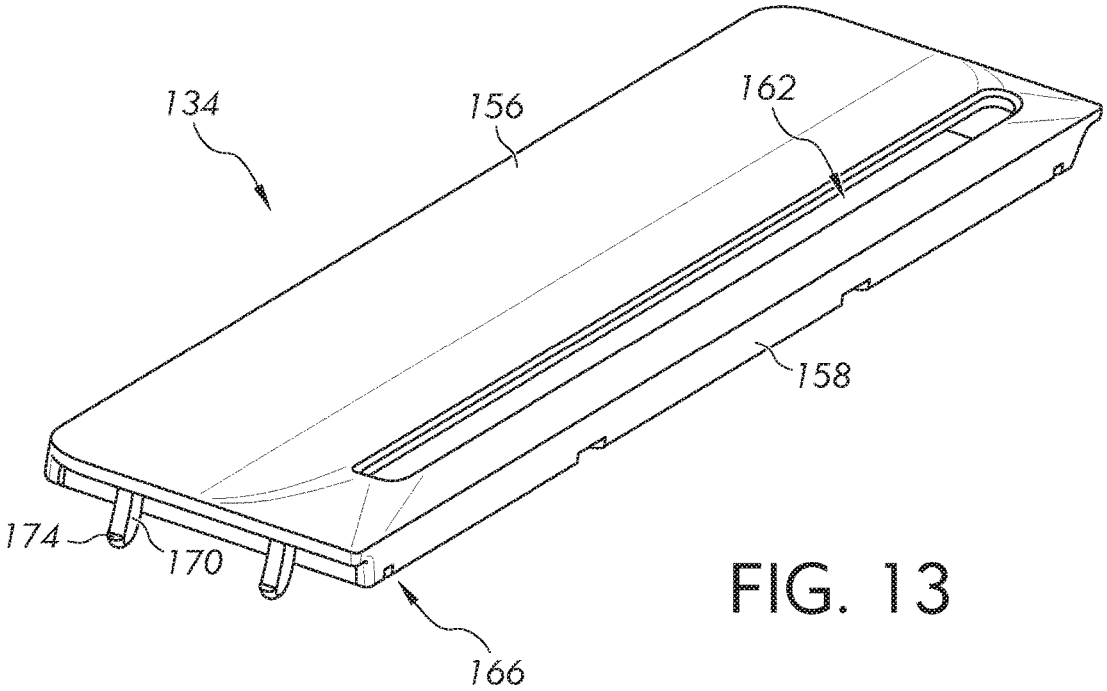
FIG. 13 is an upper perspective view of a second embodiment of the insert member for the cover.
Figure 14:
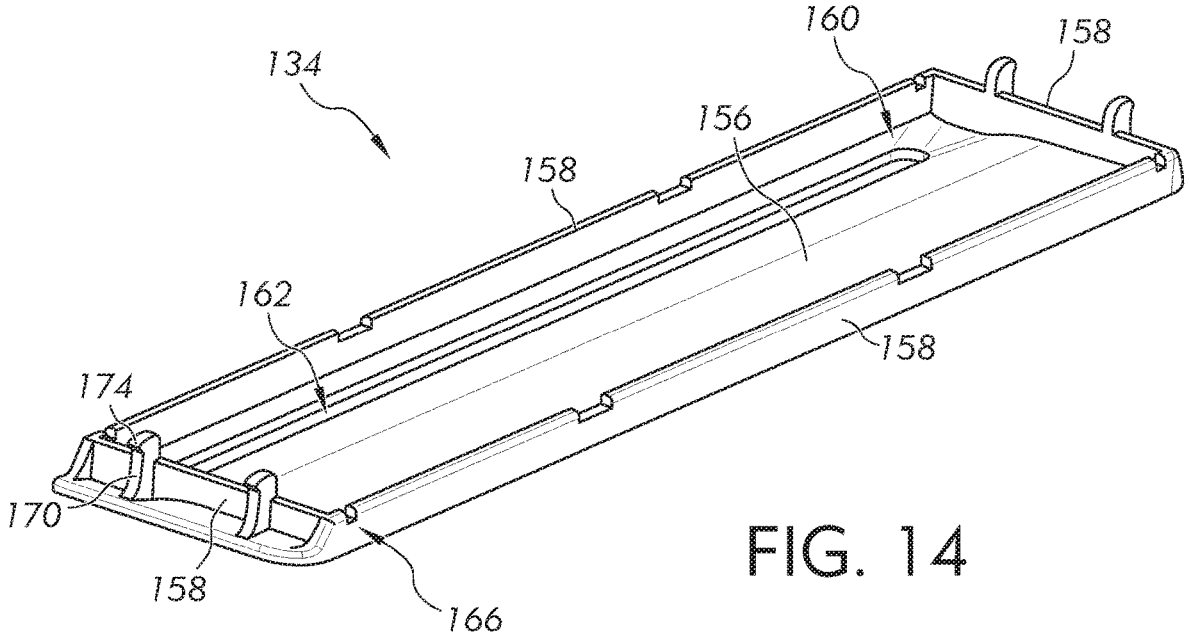
FIG. 14 is a lower perspective view of the second embodiment of the insert member.

With reference now to FIGS. 9-14, the cover 62 in some examples can further include one or more insert members 134 that can each be removably inserted into the recess 128 of a communication portion 86. FIGS. 9-12 show a first embodiment of the insert member 134, while FIGS. 13 & 14 show a second embodiment of the insert member 134. As discussed further below, each insert member 134 can be configured to passively control humidity in the storage space 70 below its associated communication portion 86 by passively controlling the egress of water in the air that passes through its communication portion 86.

As shown in FIGS. 9-12, the insert member 134 in the first embodiment can include a first member 136 and a second member 138 that can be removably connected to each other. The first member 136 can include a U-shaped upper portion 140 and a plurality of side walls 142 that extend downward from the upper portion 140. Meanwhile, the second member 138 can include a replaceable breathable membrane 144, a frame portion 146 that holds the membrane 144 and extends at least partially about a perimeter of the membrane 144, and an overhang portion 148 that extends upward from a side of the frame portion 146 and then laterally over the membrane 144. The first and second members 136, 138 are configured such that when connected, a chamber 150 is defined therebetween, along with a slot 152 that is in fluid communication with the chamber 150.

The insert member 134 in the first embodiment is designed such that when inserted into the recess 128 of a communication portion 86, its frame portion 146 will seat on the recessed surface 130 of the communication portion 86 and its membrane 144 will be positioned above the apertures 132 of the communication portion 86. Moreover, the membrane 144 in the first embodiment preferably comprises a paper-based material or some other moisture-absorbing material that can permit air from the storage space 70 below its associated communication portion 86 to pass therethrough into the chamber 150 above. In this manner, controlled (e.g., restricted) fluid communication can be established between the upper space 118 of the fresh food compartment 12 and the storage space 70 below the communication portion 86 via the apertures 132 in the communication portion 86, the breathable membrane 144, the chamber 150, and the slot 152 of the insert member 134. Moreover, as the air leaves the storage space 70 through the membrane 144, the membrane 144 can absorb moisture in the air, thereby inhibiting the egress of water vapor from the storage space 70.

Additionally, because the first and second members 136, 138 in the first embodiment are removably connected to each other, the second member 138 can be replaced with a new second member if, for example, the membrane 144 of the second member 138 gets dirty, gets moldy, or becomes too saturated with water.

As shown in FIGS. 13 & 14, the insert member 134 in the second embodiment can include a body 154 comprising an upper portion 156 and one or more leg portions 158 (e.g., side walls) that extend downward from the upper portion 156. The one or more side portions 158 can rest upon the recessed surface 130 of an associated communication portion 86 and space the upper portion 156 from the recessed surface 130 to define a chamber 160 between the upper portion 156 and the recessed surface 130. Moreover, the upper portion 156 can define a slot 162 therethrough that provides controlled (e.g., restricted) fluid communication between the chamber 160 and the upper space 118 of the fresh food compartment 12. In this manner, controlled fluid communication can be established between the upper space 118 of the fresh food compartment 12 and the storage space 70 in a storage bin 60 below the communication portion 86 via the apertures 132 in the communication portion 86, the chamber 160 between the insert member 134 and communication portion 86, and the slot 162 in the insert member 134.

Preferably, the body 154 of the insert member 134 in the second embodiment comprises a paper-based material or some other moisture absorbing material (such as the replaceable breathable membrane 144 discussed above) that will absorb moisture from the air that leaves the storage space 118 below and passes through the communication portion 86 and slot 162 defined by the body 154. In this manner, the insert member 134 in the second embodiment can inhibit the egress of water vapor from the storage space 70. Moreover, the body 154 of the insert member 134 can be replaced with a new body if, for example, the body 154 gets dirty, gets moldy, or becomes too saturated with water.

It is to be appreciated that the first and second embodiments of the insert member 134 illustrated in FIGS. 13 & 14 are merely examples and are not intended to limit the scope of the invention. Indeed, in some examples, the first embodiment of the insert member 134 may additionally or alternatively comprise one or more features of the second embodiment, or vice versa. The insert member 134 may comprise any configuration that can be inserted into a recess 128 of a communication portion 86 that will permit communication therethrough and can absorb moisture from air leaving the storage space 118 below to passively control the egress of water vapor from the storage space 70.

In some embodiments, the insert member 134 and recess 128 of its associated communication portion 86 can be configured such that the size and shape of the insert member 134 are complementary to the size and shape of the recess 128. For instance, in both of the first and second embodiments, the insert member 134 has a substantially similar shape to the recess 128, but with a slightly smaller length, width, and depth. In this manner, the insert member 134 can fit securely within the recess 128 and can be flush with the top of each side wall portion 126 surrounding the recess 128. However, the insert member 134 may be substantially smaller in length, width, and/or depth in some examples. Moreover, the insert member 134 may extend above the top of a side wall portion 126 when inserted in the recess 128 in some examples.

In some embodiments, each insert member 134 and communication portion 86 of the cover 62 can include or more mating features that will facilitate proper alignment of each insert member 134 when inserted into the recess 128 its associated communication portion 86. For example, each communication portion 86 can include one or more projections 164 (see e.g., FIG. 8) that extend upward from its lower portion 124. Meanwhile, each insert member 134 can comprise one or more recesses 166 (see e.g., FIGS. 13 & 14) defined by a portion (e.g., leg portions 158) of the insert member 134 that will receive the one or more projections 164 of its associated communication portion 86 when the insert member 134 is properly inserted into the recess 128 of the communication portion 86.

However, it is to be appreciated that each insert member 134 and communication portion 86 can comprise additional or alternative structure in other examples that can facilitate proper alignment of each insert member 134 when inserted into the recess 128 its associated communication portion 86. For instance, in some examples, each insert member 134 can comprise one or more projections that will be received by one or more recesses defined by an associated communication portion 86 when the insert member 134 is properly inserted into the recess 128 of the communication portion 86.

In some embodiments, each insert member 134 can be designed to have a snap-fit connection with its associated communication portion 86. For example, each insert member 134 can comprise one or more latching arms 170 (see e.g., FIGS. 11 & 14) that can extend downward from a portion (e.g., the side walls 142 or leg portions 158) of the insert member 134. Meanwhile, each communication portion 86 can comprise one or more latching holes 172 (see e.g., FIG. 8) that are defined by and extend through its lower portion 124. The one or more latching arms 170 of each insert member 134 can be designed such that when the insert member 134 is properly inserted into the recess 128 its associated communication portion 86, the one or more latching arms 170 will extend through the latching holes 172 of the communication portion 86. Moreover, the latching arms 170 can each include a catch 174 that will engage an underside of the communication portion 86 to lock the insert member 134 in place.

However, it is to be appreciated that each insert member 134 and communication portion 86 can comprise additional or alternative structure that can provide a snap-fit connection in other examples. For instance, in some examples, each communication portion 86 can include one or more latching arms that will extend through one or more latching holes defined by an associated insert member 134 when the insert member 134 is inserted into the recess 128 of the communication portion 86. Moreover, in some examples, each insert member 134 may simply rest within the recess 128 of its associated communication portion 86 without any snap-fit connection.

As noted above, each communication portion 86 can be designed such that when an insert member 134 is inserted into the recess 128 of the communication portion 86, the insert member 134 will be flush with the top of the side wall portions 126 surrounding the recess 128. Preferably, the insert member 134 and side wall portions 126 will also be flush or just slightly elevated from the remaining upper surfaces of cover 62 (e.g., the upper surface 88 of the panel 82). To facilitate such alignment, the recessed surface 130 of each communication portion 86 can be disposed lower than the upper surface 88 of the panel 82, thereby enabling the insert member 134 and side wall portions 126 to be similar in elevation or flush with the upper surface 88. In this manner, the cover 62 can have a substantially flat upper surface across its entire length and width that is aesthetically pleasing and provides a large surface area for items to be stored thereon.

The cover 62 has been described above as being applied to one or more storage bins 60 within the fresh food compartment 12 of the refrigerator appliance 10. However, it is to be appreciated that the cover 62 may be applied to one or more storage bins in other storage compartments of the appliance 10 such as, for example, the VCZ compartment 14 or the freezer compartment 16.

Turning to FIGS. 15-24, an example shelf assembly 202 for the refrigerator 10 will now be described. It is to be understood that the following discussion of the shelf assembly 202 is intended to be a separate embodiment that can be separately used from the previously described cover 62. Optionally, a refrigerator can include both of the shelf assembly 202 and the cover 62.

Figure 15:
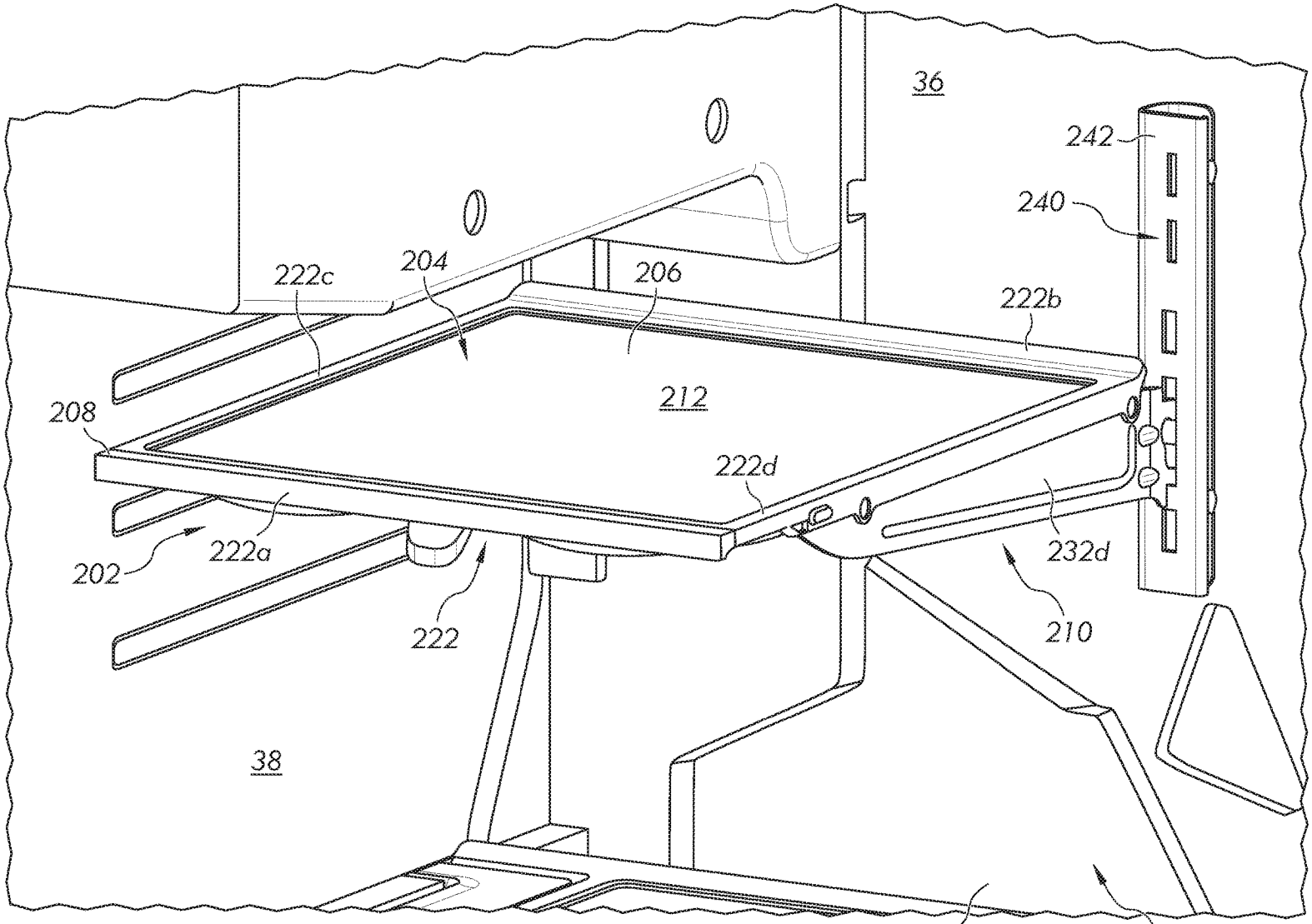
FIG. 15 is a perspective view of a shelf assembly in the fresh food compartment of the refrigerator.

As can be seen in FIG. 15, the shelf assembly 202 can include a shelf 204 having a panel 206 and a frame 208 that is coupled to the panel 206 and extends at least partially about a perimeter of the panel 206. Moreover, in some examples, the shelf assembly 202 can include a support unit 210 for mounting the shelf 204 within a storage compartment (e.g., fresh food compartment 12) of the refrigerator 10, as discussed further below.

Figure 16:
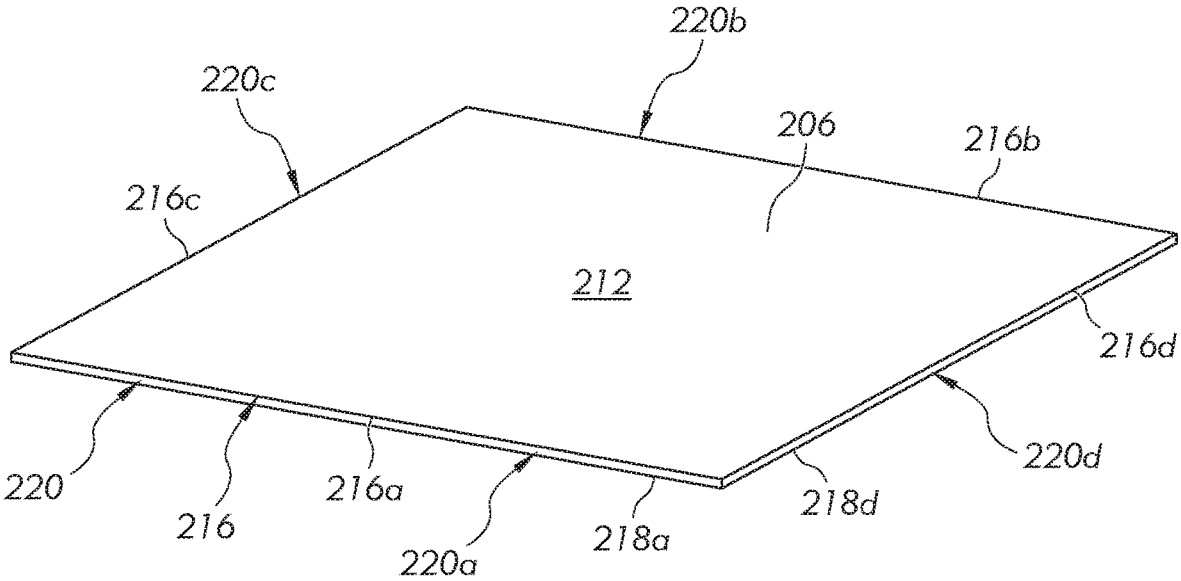
FIG. 16 is an upper perspective view of a panel for the shelf assembly.
Figure 17:
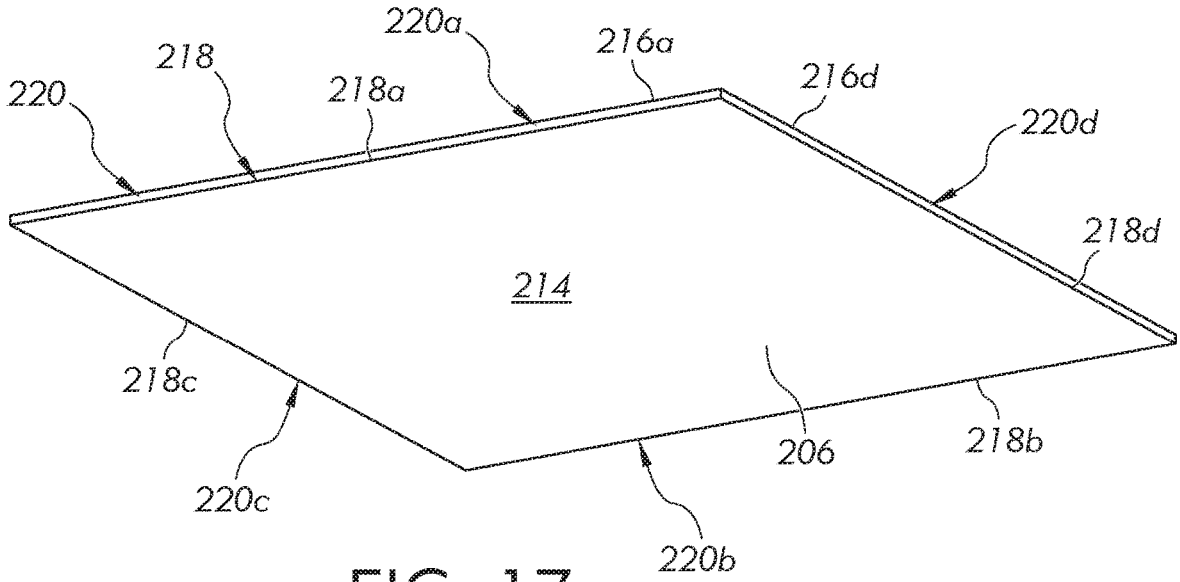
FIG. 17 is a lower perspective view of the panel for the shelf assembly, with a wine rack in a stored configuration.

FIGS. 16 & 17 illustrate the panel 206 of the shelf 204 in isolation. In particular, FIG. 16 is a top perspective view of the panel 206, while FIG. 17 is a bottom perspective view of the panel 206. As can be seen in FIGS. 16 & 17, the panel 206 can include an upper surface 212 and a lower surface 214 spaced from the upper surface 212 that faces an opposite direction from the upper surface 212.

The upper surface 212 of the panel 206 can comprise a shape defined by a plurality of edges 216. For instance, as shown in FIG. 16, the upper surface 212 in the illustrated embodiment comprises a substantially rectangular shape defined by a front edge 216*a*, a rear edge 216*b*, a left edge 216*c*, and a right edge 216*d*. The front edge 216*a* and rear edge 216*b* are spaced from and extend substantially parallel to each other along a first direction. Meanwhile, the left edge 216*c* and the right edge 216*d* are spaced from and extend substantially parallel to each other along a second direction that is substantially perpendicular to the first direction. However, the upper surface 212 may comprise other shapes defined by edges of different configurations in other embodiments. Moreover, although the edges 216 in the present embodiment are all substantially straight, one or more of the edges 216 may be curved in other embodiments.

The lower surface 214 of the panel 206 can have a substantially similar shape as the upper surface 212 that is similarly defined by a plurality of edges 218 (see e.g., FIG. 17). Each edge 218 of the lower surface 214 can be spaced from and extend substantially parallel to a corresponding edge 216 of the upper surface 212. For example, the lower surface 214 in the present embodiment has a front edge 218*a* that is spaced from and extends substantially parallel to the front edge 216*a* of the upper surface 212, a rear edge 218*b* that is spaced from and extends substantially parallel to the rear edge 216*b* of the upper surface 212, a left edge 218*c* that is spaced from and extends substantially parallel to the left edge 216*c* of the upper surface 212, and a right edge 218*d* that is spaced from and extends substantially parallel to the right edge 216*d* of the upper surface 212.

The panel 206 can further include a plurality of edge surfaces 220 that extend between and abut corresponding edges 216, 218 of the upper surface 212 and lower surface 214. For example, the panel 206 in the present embodiment includes a front edge surface 220*a* that extends between and abuts the front edge 216*a* of the upper surface 212 and the front edge 218*a* of the lower surface 214, a rear edge surface 220*b* that extends between and abuts the rear edge 216*b* of the upper surface 212 and the rear edge 218*b* of the lower surface 214, a left edge surface 220*c* that extends between and abuts the left edge 216*c* of the upper surface 212 and the left edge 218*c* of the lower surface 214, and a right edge surface 220*d* that extends between and abuts the right edge 216*d* of the upper surface 212 and the right edge 218*d* of the lower surface 214.

The panel 206 described above can comprise glass or some other material such as, for example, molded plastic. For ease of illustration, the drawings in the present disclosure show the panel 206 as an opaque structure. However, it is to be appreciated that the panel 206 may be transparent or translucent in some embodiments.

The frame 208 of the shelf 204 will now be described in further detail. As shown in FIG. 15, the frame 208 can include one or more trim members 222 that extend along one more edges 216, 218 of the panel 206. For instance, in the illustrated embodiment, the frame 208 includes a front trim member 222*a* that extends along the front edges 216*a*, 218*a* of the panel 206, a rear trim member 222*b* that extends along the rear edges 216*b*, 218*b* of the panel 206, a left trim member 222*c* that extends along the left edges 216*c*, 218*c* of the panel 206, and a right trim member 222*d* that extends along the right edges 216*d*, 218*d* of the panel 206.

Figure 18:
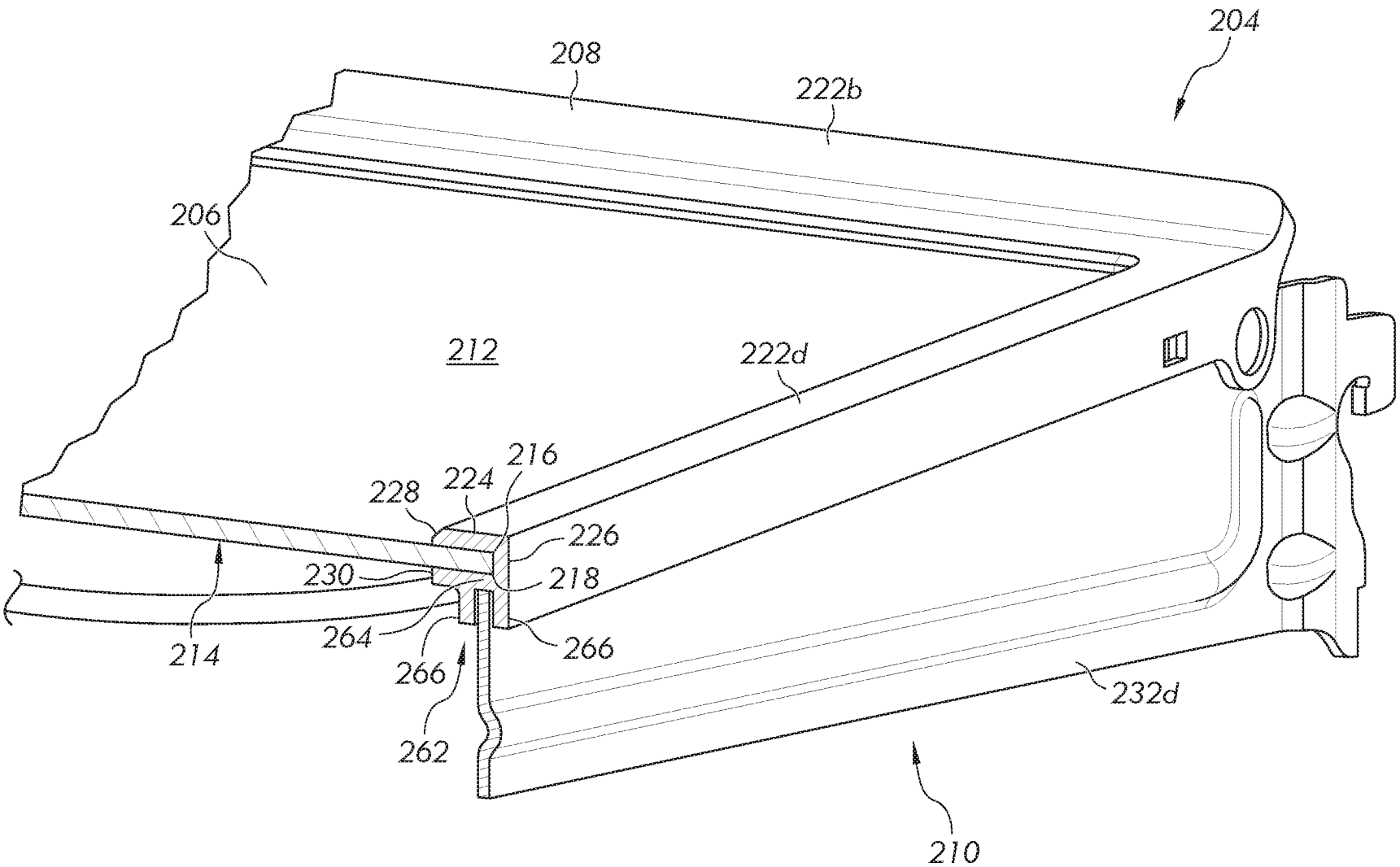
FIG. 18 is a first cross-section view of the shelf assembly.

As shown in FIG. 18, each trim member 222 can have a U-shaped portion 224 that wraps around its associated edges 216, 218. In particular, the U-shaped portion 224 can include an outer portion 226, an upper portion 228 that extends inward (i.e., toward a center of the panel 206) from the outer portion 226 above the upper surface 212 of the panel 206, and a lower portion 230 that extends inward (i.e., toward a center of the panel 206) from the outer portion 226 below the lower surface 214 of the panel 206.

The frame 208 described above can comprise a rigid plastic and be integrally formed as a monolithic body via an injection molding process. In particular, the frame 208 can be overmolded onto the panel 206 such that its trim member (s) 222 wrap around their associated edges 216, 218. However, the frame 208 may comprise other materials and/or may be formed by other processes in other examples. Indeed, in some examples, the frame 208 may be integrally formed with the panel 206 such that the frame 208 and panel 206 are part of a single body. In other examples, the frame 208 can include separate elements (e.g., separate trim members 222) that are separately attached to each other to form the frame 208. Moreover, in some examples, shelf 204 may not include the frame 208 and may have a frameless panel 206.

The shelf 204 described above can be mounted within the fresh food compartment 12 in a variety of different manners. For example, the refrigerator 10 can include one or more support bodies (e.g., brackets, ledges, surfaces, etc.) that the shelf 204 can be placed on to install the shelf 204 within the fresh food compartment 12. The one or more support bodies can be integrally formed with the interior liner 30 of the refrigerator 10 or the one or more support bodies can be separately formed and attached to the interior liner 30. In some examples, the shelf assembly 202 can include the support unit 210 noted above for mounting the shelf 204 within the fresh food compartment 12, which will now be described in further detail below.

Figure 19:
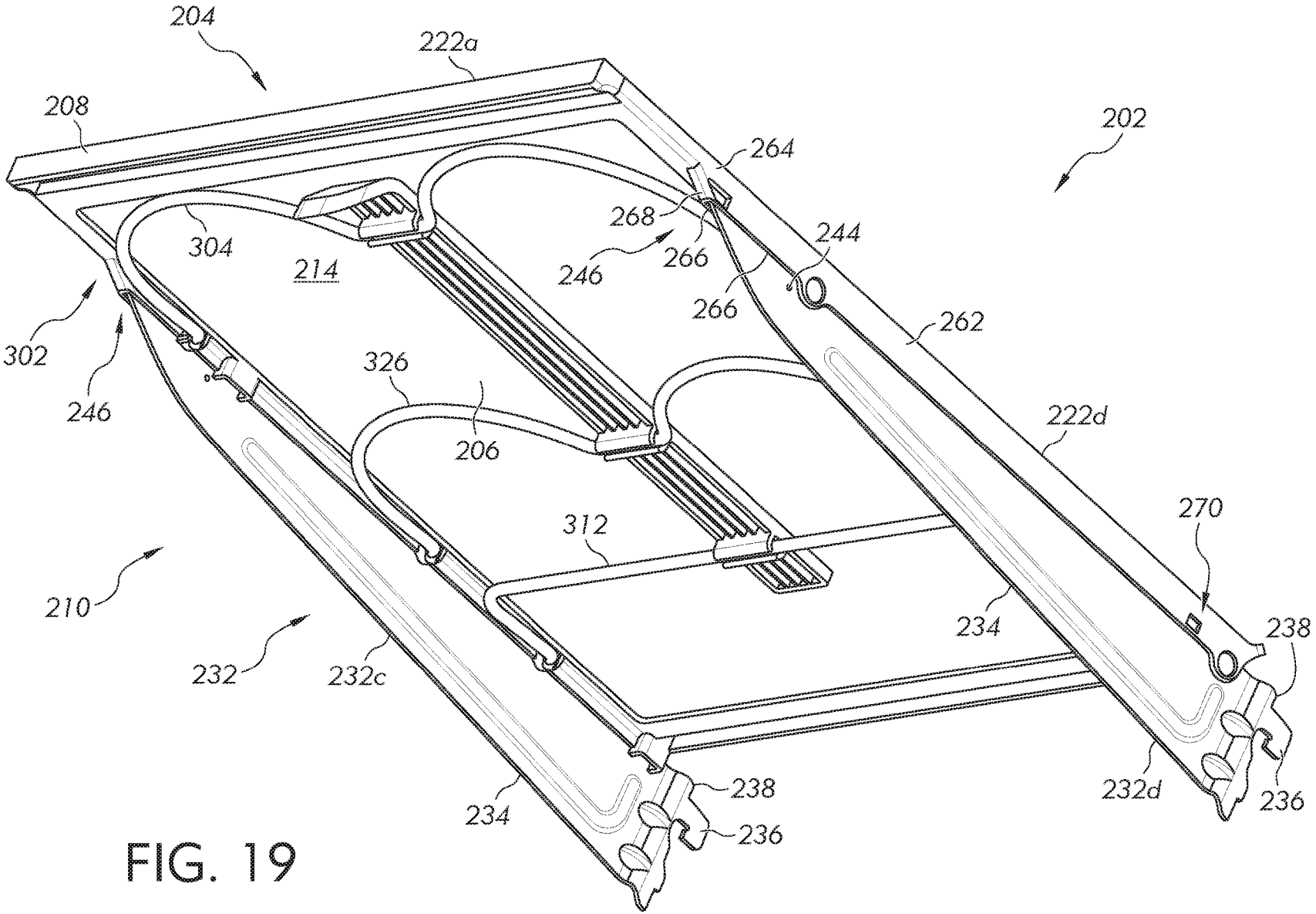
FIG. 19 is a lower perspective view of the shelf assembly.

As shown in FIG. 19, the support unit 210 can include a plurality of support arms 232 that are spaced apart from each other and extend substantially parallel to each other. In the illustrated embodiment, the support unit 210 includes a left support arm 232*c* and a right support arm 232*d*, each of which comprises bent sheet metal. However, the support unit 210 may have additional support arms 232 in other embodiments, and each support arm 232 may comprise a different material (e.g., molded plastic) in some examples.

Each support arm 232 can be fixed to a wall (e.g., rear wall 36) of the fresh food compartment 12 in a variety of different manners. For example, each support arm 232 can include an elongated body 234 and one or more hooks 236 extending from a rear end 238 of the elongated body 234. Meanwhile, the fresh food compartment 12 can comprise a plurality of apertures 240 (see e.g., FIG. 15) that the hook(s) 236 of each support arm 232 can engage (e.g., be inserted into) to cantilever the support arm 232 from the wall. In particular, the fresh food compartment 12 can comprise two vertically aligned tracks 242 (often referred to as ladder tracks) that are fixed to its rear wall 36 and define two or more vertically-aligned rows of apertures 240 that will permit the support arms 232 of the support unit 210 to be installed at various heights along the rear wall 36.

Once a support arm 232 is hooked onto the rear wall 36, the support arm 232 will be cantilevered from the rear wall 36 such that its elongated body 234 extends substantially perpendicular from the rear wall 36 and substantially parallel to the left and right side walls 38, 40 of the fresh food compartment 12. In some examples, the support arm 232 can then be fastened to adjacent structure (e.g., the left side wall 38, the right side wall 40, or an adjacent shelf assembly) with a screw that passes through a hole 244 in the support arm 232 and is threaded into an threaded aperture in the adjacent structure. This fastening of the support arm 232 can help rigidly secure the support arm 232 in the fresh food compartment 12. However, the support arm 232 may not be fastened to adjacent structure in some examples and may simply be hooked to the rear wall 36.

It is to be appreciated that the support arms 232 of the support unit 210 described above can be fixed to any wall of the refrigerator, and in a variety of different manners, without departing from the scope of the invention.

While the support arms 232 are fixed to the fresh food compartment 12, the shelf 204 can be placed onto the support arms 232 to mount the shelf 204 within the fresh food compartment 12. In some examples, the shelf 204 can simply rest on the support arms 232 and freely move relative to the support arms 232 with little obstruction. In other examples, the shelf assembly 202 can include one or more features that can help position the shelf 204 onto the support arms 232 and inhibit relative movement between the shelf 204 and support arms 232.

Figure 20:
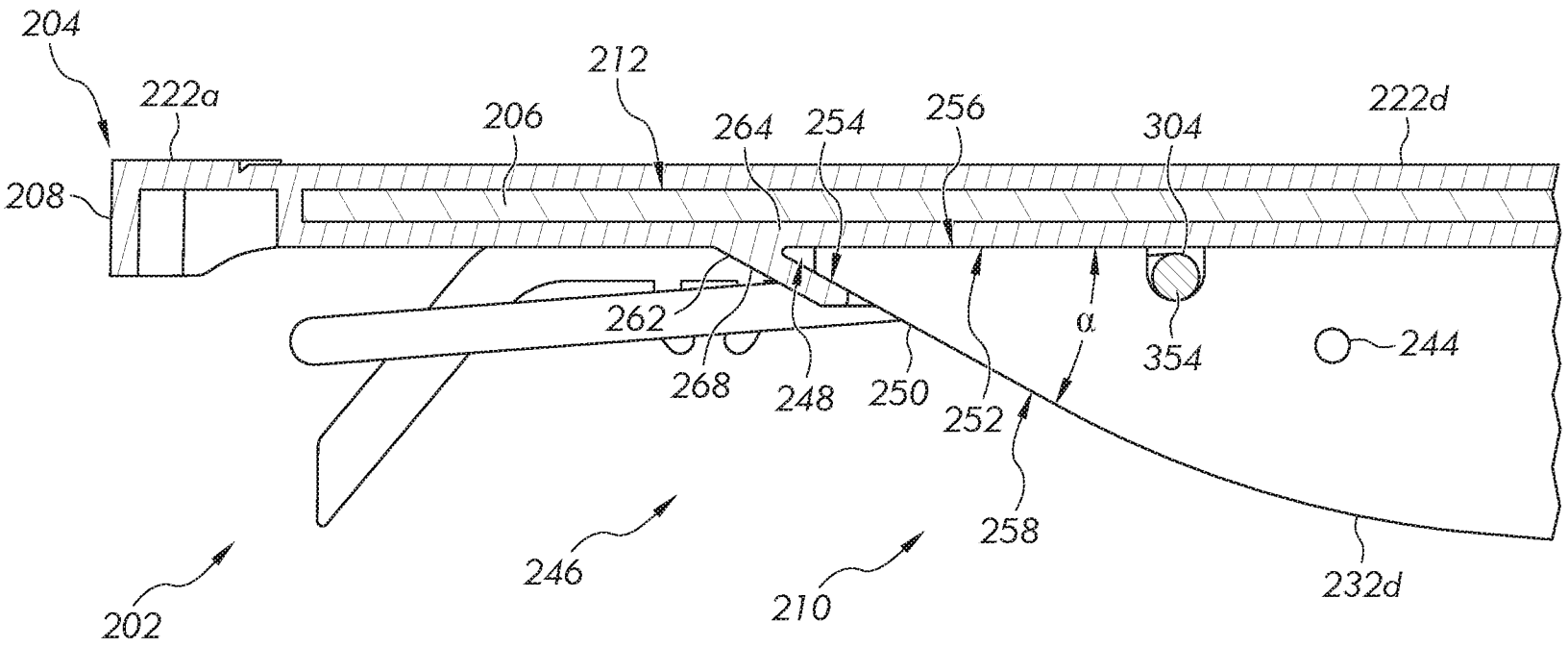
FIG. 20 is a second cross-section view of the shelf assembly.

For example, as shown in FIGS. 19 & 20, the shelf assembly 202 can include one or more mating assemblies 246 that each comprises an angular pocket 248 and a wedge-shaped insertion member 250 that can mate with and reside within the angular pocket 248 to facilitate mounting of the shelf 204 onto the support arms 232. The angular pocket 248 is defined at least partially by an upper surface 252 and a lower surface 254 that faces the upper surface 252 and is arranged relative to the upper surface 252 at an acute angle $\alpha$. Meanwhile, the insertion member 250 has an upper surface 256 and a lower surface 258 that are complementary to the upper surface 252 and lower surface 254 of the angular pocket 248, respectively. In particular, the upper and lower surfaces 256, 258 of the insertion member 250 face away from each other and are similarly angled relative to each other at the acute angle $\alpha$.

The angular pocket 248 of each mating assembly 246 can be defined by one of the shelf 204 and support unit 210, while the insertion member 250 of each mating assembly 246 can be defined by the other of the shelf 204 and support unit 210.

For instance, FIGS. 19 & 20 show an example mating assembly 246 wherein the angular pocket 248 of the mating assembly 246 is defined by the right trim member 222*d* of the shelf 204, while the insertion member 250 is defined by the right support arm 232*d* of the support unit 210. More specifically, the right trim member 222*d* can define a guide member 262 comprising an upper wall 264, a pair of side walls 266 spaced from each other and extending downward from the upper wall 264, and a ramped wall 268 extending from the upper wall 264 at the acute angle α and connecting front ends of the side walls 266. The upper wall 264 and ramped wall 268 of the guide member 262 can respectively define the upper surface 252 and lower surface 254 of the angular pocket 248 of the mating assembly 246. Moreover, a front end portion of the right support arm 232*d* can define the insertion member 250 of the mating assembly 246. The angular pocket 248 and insertion member 250 can be orientated such that their acute angle α opens towards a rear of the shelf assembly 202.

A second mating assembly 246 may be similarly defined by the left trim member 222*c* of the shelf 204 and the left support arm 232*c* of the support unit 210. However, it is to be appreciated that the configuration of the mating assembly 246 in FIGS. 19 & 20 is merely an example and one or more mating assemblies 246 of the shelf assembly 202 may have alternative configurations in other examples. For instance, in some examples, the angular pocket 248 of a mating assembly 246 may be defined by some other structure of the shelf 204 such as its panel 206 or another portion of its frame 208. Likewise, the insertion members 250 of the mating assembly 246 may be defined by some other structure of the support unit 210 such as, for example, an intermediate portion or rear portion of a support arm 232. Still further in some examples, the angular pocket 248 of a mating assembly 246 may be defined by a guide member on a support arm 232, while the insertion members 250 of the mating assembly 246 can be defined by a portion of the shelf 204. Still yet further in some examples, the angular pocket 248 and insertion member 250 of a mating assembly 246 may be oriented such that their acute angle α opens a different direction (e.g., forward). Each mating assembly 246 can comprise any configuration of an angular pocket and complementary insertion member without departing from the scope of the invention.

Figure 21:
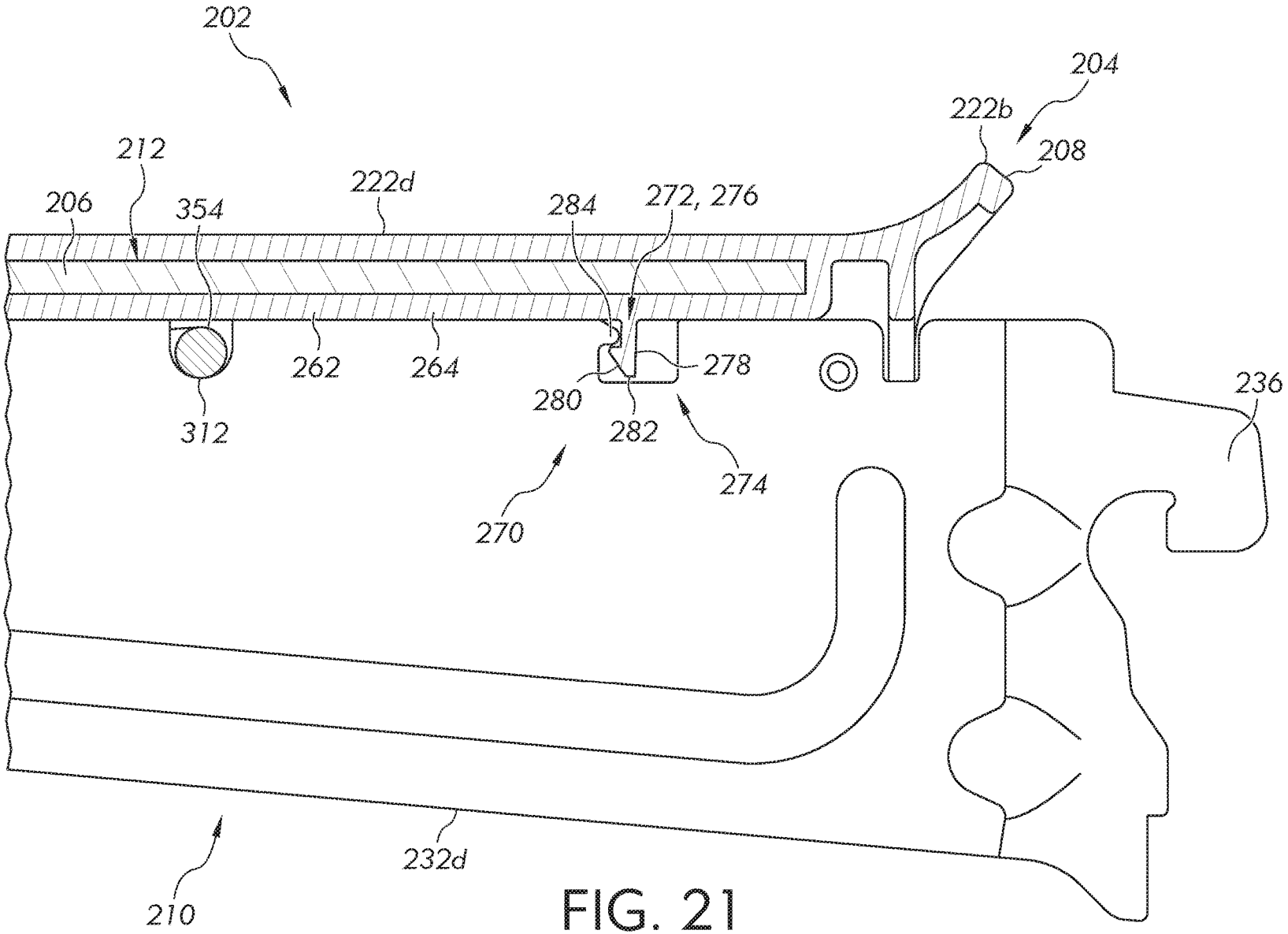
FIG. 21 is a third cross-section view of the shelf assembly.

Turning to FIG. 21, the shelf assembly 202 can further include one or more latching assemblies 270 which can cooperate with the one or more mating assemblies 246 described above to facilitate mounting of the shelf 204 onto the support unit 210. Each latching assembly 270 can include a first latching member 272 and a second latching member 274 that can be latched to the first latching member 272. The first latching member 272 can comprise a clip arm 276 having an elongated body 278 and a hook portion 280 that extends from a side of the elongated body 278. Meanwhile, the second latching member 274 can comprise a recess 282 that can receive the clip arm 276 of the first latching member 272, and a latch 284 that will be vertically aligned with the hook portion 280 of the clip arm 276 when inserted into the recess 282, thereby inhibiting vertical movement of the clip arm 276 out of the recess 282.

The first latching member 272 of each latching assembly 270 can be defined by the shelf 204 and support unit 210, while the second latching member 274 of each latching assembly 270 can be defined by the other of the shelf 204 and support unit 210.

For instance, FIG. 21 shows an example latching assembly 270 wherein the first latching member 272 of the latching assembly 270 is defined by the right trim member 222*d* of the shelf 204, while the second latching member 274 of the latching assembly 270 is defined by the right support arm 232*d* of the support unit 210. More specifically, the first latching member 272 is arranged within the guide member 262 of the right trim member 222*d* such that its elongated body 278 extends downward from the upper wall 264 of the guide member 262 between the guide member's side walls 266, and its hook portion 280 extends forward from its elongated body 278. Moreover, the recess 282 and latch 284 of the second latching member 274 are defined by an intermediate portion of the left support arm 232*c* such that the latch 284 extends over a portion of the recess 282 in a rearward direction.

A second latching assembly 270 may be similarly defined by the left trim member 222*c* of the shelf 204 and the left support arm 232*c* of the support unit 210. However, it is to be appreciated that the configuration of the latching assembly 270 in FIG. 21 is merely an example and one or more latching assemblies 270 of the shelf assembly 202 may have alternative configurations in other examples. For instance, the first latching member 272 of a latching assembly 270 may be defined by some other structure of the shelf 204 such as its panel 206 or another portion of its frame 208. Moreover, the first and second latching members 272, 274 of a latching assembly 270 may be may be provided at different locations and/or with different orientations in some examples. Still further in some examples, the first latching member 272 of a latching assembly 270 may be defined by a support arm 232 of the support unit 210, while the second latching member 274 of the latching assembly 270 can be defined by a portion of the shelf 204. Each latching assembly 270 can comprise any configuration of first and second latching members that latch with each other during mounting of the shelf 204 without departing from the scope of the invention.

The mating assemblies 246 and latching assemblies 270 described above are designed such that the following method can be implemented to assemble the shelf assembly 202 within a storage compartment (e.g., fresh food compartment 12) of the refrigerator 10.

First, the support arms 232 of the support unit 210 can be attached to a wall (e.g., rear wall 36) of the fresh food compartment 12 such that its support arms 232 extend substantially horizontal and substantially perpendicular from the wall.

Next, the shelf 204 can be angled such that its upper surface 212 is sloped along the front-to-rear direction of the refrigerator 10. For example, the shelf 204 can be angled such that its upper surface 212 slopes upward along the front-to-rear direction of the refrigerator 10. In this orientation, the shelf 204 can be assembled onto the support arms 232 of the support unit 210 such that the insertion member 250 of each mating assembly 246 is inserted into its associated angular pocket 248. This mating of the insertion member 250 and angular pocket 248 will facilitate proper positioning of the shelf 204 along the front-to-rear direction of the refrigerator 10, as well as inhibit movement of the shelf 204 along the direction in which the acute angle α of the angular pocket 248 points (e.g., forward).

Once the insertion member 250 and angular pocket 248 of the each mating assembly 246 are mated with each other, the shelf 204 can be tilted downward such that its upper surface 212 assumes a substantially horizontal orientation. As the shelf 204 is tilted downward, the first and second latching members 272, 274 of each latching assembly 270 will latch to each other, thereby securing the shelf 204 to the support unit 210. In particular, the clip arm 276 of each first latching member 272 will be inserted vertically into the recess 282 of its associated second latching member 274. As the clip arm 276 enters the recess 282, the latch 284 of the second latching member 274 will interfere with the clip arm's hook portion 280 and cause the clip arm 276 to deflect slightly. Eventually, the hook portion 280 of the clip arm 276 will surpass the latch 284 and come to rest within the recess 282 in a position that is vertically aligned with the latch 284. This vertical alignment of the latch 284 and hook portion 280 will inhibit vertical movement of the shelf 204 off of the support unit 210.

The shelf assembly 202 has been described above as being applied mounted within the fresh food compartment 12 of the refrigerator appliance 10. However, it is to be appreciated that the shelf assembly 202 may be mounted within other storage compartments of the appliance 10 such as, for example, the VCZ compartment 14 or the freezer compartment 16.

Figure 22:
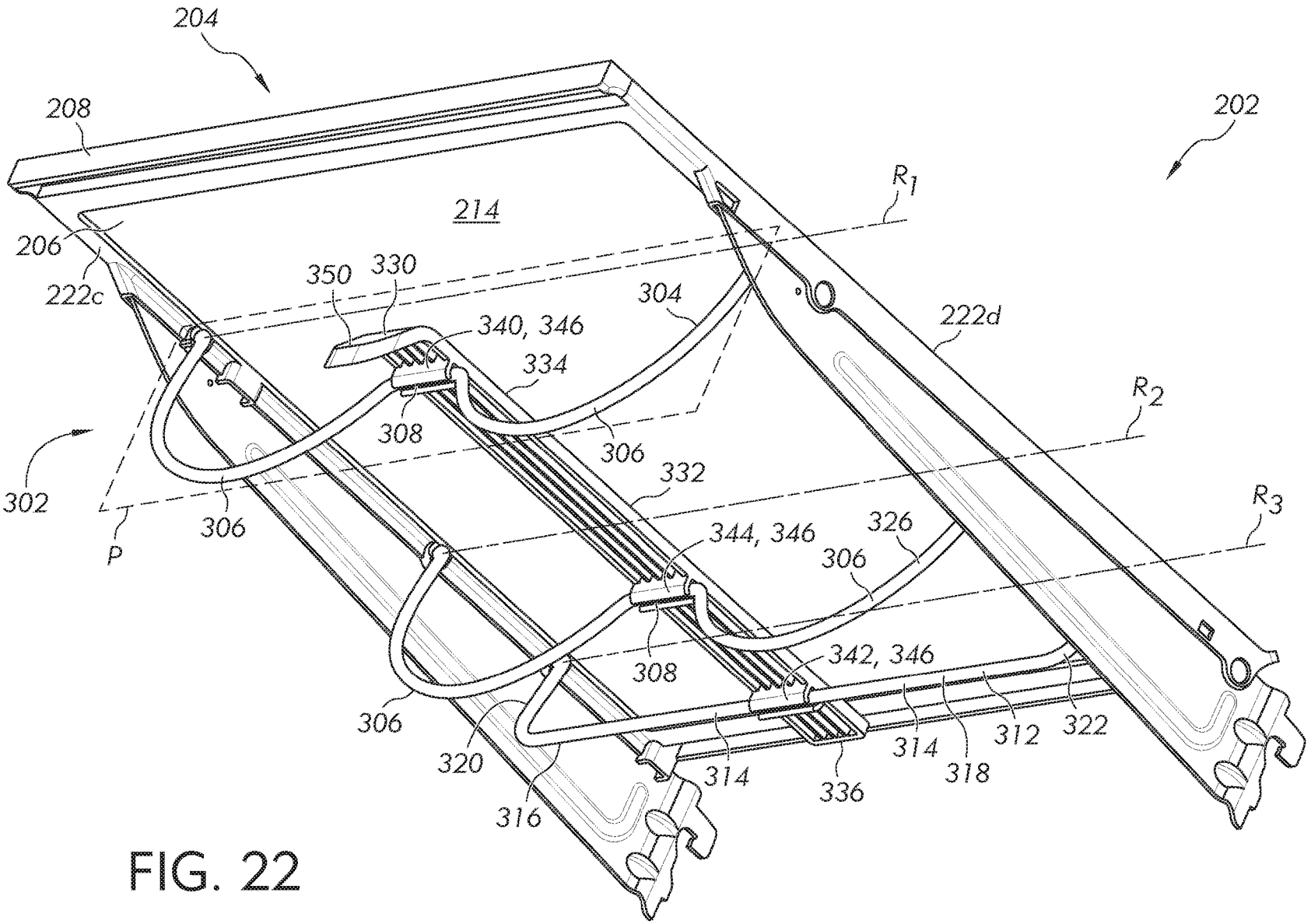
FIG. 22 is a lower perspective view of the panel for the shelf assembly, with the wine rack in a deployed configuration.
Figure 23:
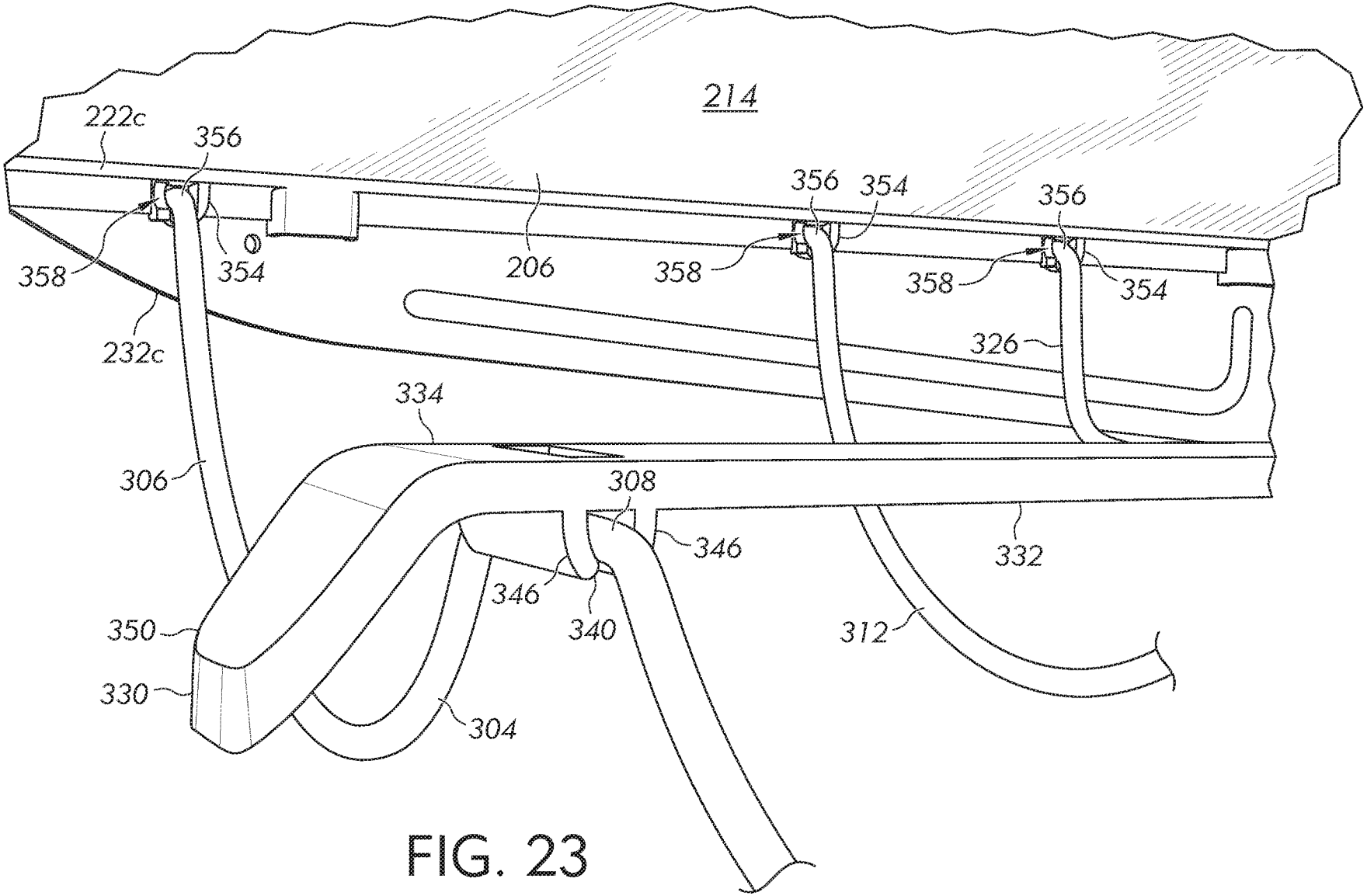
FIG. 23 is a close-up perspective view of the wine rack of the shelf assembly.
Figure 24:
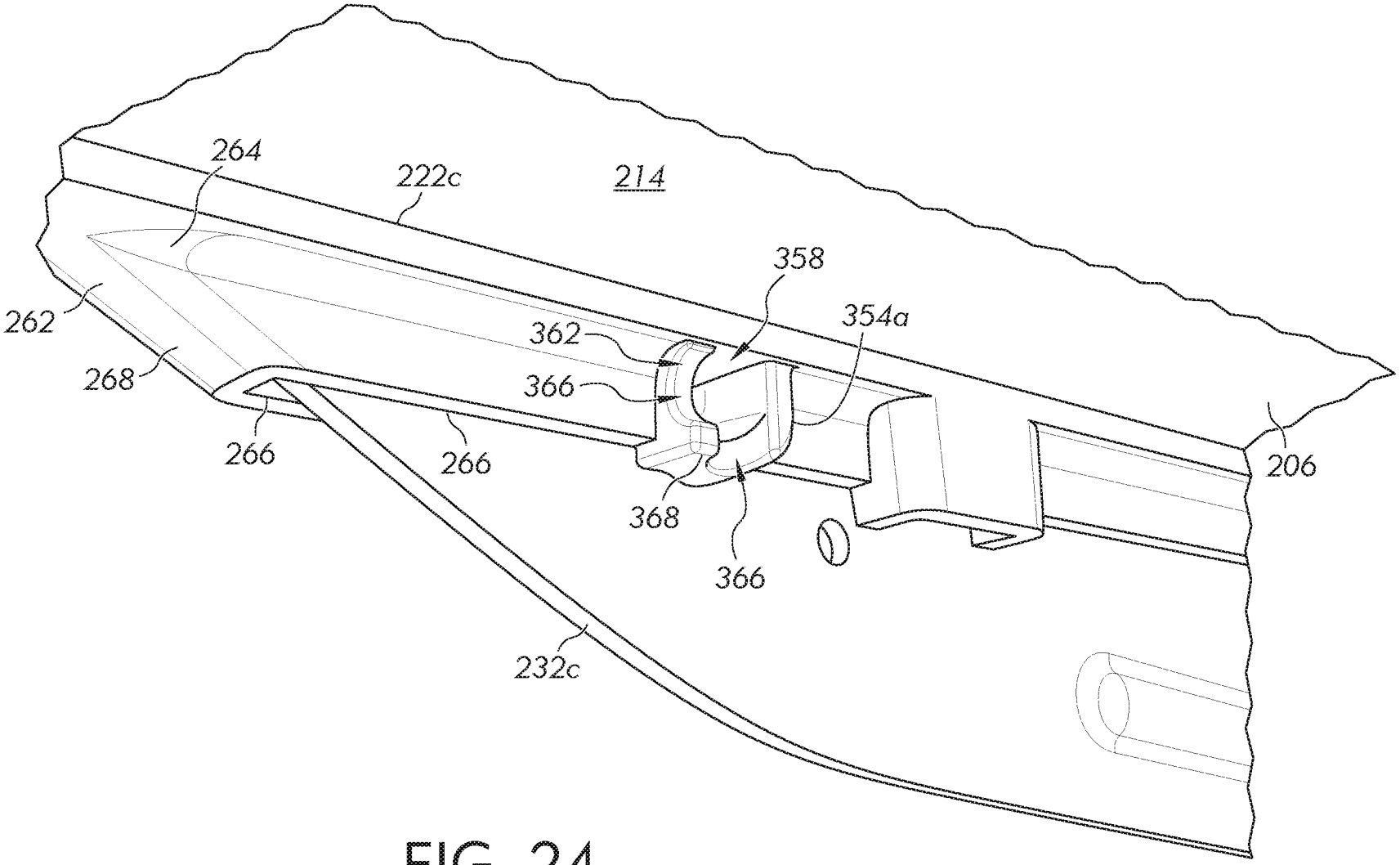
FIG. 24 is a close-up perspective view of a cylindrical body of the wine rack.

With reference now to FIGS. 22-24, the shelf assembly 202 in some examples can include a wine rack 302 that is coupled to the shelf 204 and adjustable between a stored configuration and a deployed configuration. FIG. 22 illustrates the wine rack 302 in its deployed configuration, while FIGS. 23 & 24 show various aspects of the wine rack 302 in close-up and/or in isolation. It is to be understood that the wine rack 302 is an optional element that can be used together with the shelf assembly 202.

As shown in FIG. 22, the wine rack 302 can include a front wire 304 that is rotatably coupled to the shelf 204 such that the front wire 304 is rotatable about a first rotational axis $R_1$. The front wire 304 can be bent such that the front wire 304 comprises a plurality of undulation portions 306 which extend (e.g., bend) along a common plane $P_1$. The front wire 304 can further comprise one or more linear portions 308, each linear portion 308 being between and connecting adjacent undulation portions 306. The one or more linear portions 308 can also extend along the plane $P_1$.

In the illustrated embodiment, the front wire 304 includes two undulation portions 306 connected by a single linear portion 308. However, the front wire 304 can comprise any number of undulation portions 306 and/or linear portions 308 in other examples. Moreover, in some examples, the undulation portions 306 may be connected by non-linear portions or may be directly connected to each other without an intermediate structure.

The wine rack 302 can further include a rear wire 312 that is rotatably coupled to the shelf 204 such that the front wire 304 is rotatable about a rear rotational axis $R_2$ that is substantially parallel to and located rearward of the first rotational axis $R_1$ of the front wire 304. The rear wire 312 can include a plurality of stop portions 314 that are each rearwardly aligned with an associated undulation portion 306 of the front wire 304.

In the illustrated embodiment, the rear wire 312 comprises a U-shaped portion 316 having a linear segment 318, a first arm segment 320, and a second arm segment 322 that extend from opposite ends of the linear segment 318 in a direction substantially perpendicular to the linear segment 318. The U-shaped portion 316 is arranged substantially parallel to the plane P of the front wire 304. Moreover, the stop portions 314 of the rear wire 312 are defined by the linear segment 318 of the U-shaped portion 316. However, it is to be appreciated that the rear wire 312 may comprise other shapes and/or arrangements in other examples. For instance, in some examples, the rear wire 312 may comprise a plurality of undulation portions that each define a corresponding stop portion 314.

In some examples, the wine rack 302 can include one or more intermediate wires 326 that are located between the front wire 304 and rear wire 312 and are similarly rotatably coupled to the shelf 204. Each intermediate wire 326 can be substantially similar in shape and substantially parallel to the front wire 304 or rear wire 312.

For instance, in the illustrated embodiment, the wine rack 302 includes a single intermediate wire 326 that is rotatably coupled to the shelf 204 such that the intermediate wire 326 is rotatable about a third rotational axis $R_3$ that is substantially parallel to and located between the first and second rotational axes $R_1$, $R_2$ of the front wire 304 and rear wire 312. The intermediate wire 326 is substantially similar in shape to the front wire 304 such that the intermediate wire 326 similarly includes a plurality of undulation portions 306 connected by one or more linear portions 308. Moreover, the intermediate wire 326 is arranged substantially parallel to the front wire 304. In particular, the intermediate wire 326 is arranged such that the undulation portions 306 of the intermediate wire 326 extend substantially parallel to the plane P of the front wire 304 and are each aligned with an associate undulation portion 306 of the front wire 304 and an associated stop portion 314 of the rear wire 312. However, it is to be appreciated that intermediate wire(s) 326 of the wine rack 302 may have other configurations in other examples. Moreover, the wine rack 302 may not include any intermediate wires 326 in some examples.

In some examples, the wine rack 302 can include a connection arm 330 that is pivotally coupled to the wires of the wine rack 302 such that the wires will rotate about their respective axes in unison. The connection arm 330 can include a linkage member 332 having a front end 334 and a rear end 336. The linkage member 332 can be an elongated body that is substantially horizontal and substantially perpendicular to the first and second rotational axes $R_1$, $R_2$ of the front and rear wires 304, 312.

The connection arm 330 can further include a front bushing 340 provided at the front end 334 of the linkage member 332 that pivotally engages the front wire 304, and a rear bushing 342 provided at the rear end 336 of the linkage member 332 that pivotally engages the rear wire 312. Moreover, in examples wherein the wine rack 302 includes one or more intermediate wires 326, the connection arm 330 can further include one or more intermediate bushings 344 that each pivotally engage an associated intermediate wire 326.

Each bushing 340, 342, 344 of the connection arm 330 can include a pair of attachment arms 346 that can snappingly receive and wrap around its associated wire. In particular, the attachment arms 346 of the front bushing 340 can snappingly receive and wrap around a linear portion 308 of the front wire 304, the attachment arms 346 of the rear bushing 342 can snappingly receive and wrap around the linear segment 318 of the rear wire 312, and the attachment arms 346 of the intermediate bushing(s) 344 can snappingly receive and wrap around a linear portion 308 of their associated intermediate wire 326. However, each bushing 340, 342, 344 may comprise other structure to pivotally couple the bushing to its associated wire such as, for example, a cylindrical tube. Moreover, each bushing 340, 342, 344 may be coupled to a different portion of its associated wire than as shown in the illustrated embodiment.

In some examples, the connection arm 330 can include a handle 350 that extends from the front end 334 of its linkage member 332. In particular, the handle 350 can extend in a direction transverse to a longitudinal axis of the linkage member 332 and more particularly, in a downward direction that is oblique to the longitudinal axis. However, the handle 350 may comprise other orientations and/or may extend from other locations along the linkage member 332 in other examples.

As discussed above, the connection arm 330 can be pivotally attached to each wire of the wine rack 302 such that the wires will rotate about their respective axes in unison. In particular, the connection arm 330 can be pivotally connected to the front, rear, and intermediate wires 304, 312, 326 such that the undulation portions 306 and U-shaped portion 316 of the wires will remain substantially parallel to each other as the wires are rotated in unison about their respective rotational axes $R_1$, $R_2$, $R_3$. In this manner, the wine rack 302 can be adjusted between its stored configuration and deployed configuration by moving the handle 350 of the connection arm 330 to rotate the front, rear, and intermediate wires 304, 312, 326 in unison about their respective rotational axes $R_1$, $R_2$, $R_3$.

When the wine rack 302 is in its deployed configuration (see e.g., FIG. 22), the front, rear, and intermediate wires 304, 312, 326 can be positioned about their respective rotational axes $R_1$, $R_2$, $R_3$ such that the wires 304, 312, 326 have a substantially vertical orientation and extend downward from their respective rotational axes $R_1$, $R_2$, $R_3$. In particular, the undulation portions 306 and U-shaped portion 316 of the wires can be arranged substantially vertical and parallel to each other. Moreover, the undulation portions 306 of the front and intermediate wires 304, 326 can extend below their associated stop portions 314 of the rear wire 312. In other words, the stop portions 314 will be elevated with respect to the undulation portions 306 of the front and intermediate wires 304, 326. In this manner, a wine bottle can be supported by the wine rack 302 in a substantially horizontal position, with its body resting on aligned undulation portions 306 of the front and intermediate wires 304, 326, and its neck resting on an elevated stop portion 314 of the rear wire 312. Moreover, the elevated stop portion 314 will inhibit rearward movement of the wine bottle, since the stop portion 314 will interfere with the body of the wine bottle if moved in a rearward direction.

When the wine rack 302 is in its stored configuration (see e.g., FIG. 19), the front, rear, and intermediate wires 304, 312, 326 can be positioned about their respective rotational axes such that the wires 304, 312, 326 have a substantially horizontal orientation and extend forward from their respective rotational axes $R_1$, $R_2$, $R_3$. In particular, the undulation portions 306 and U-shaped portion 316 of the wires can be arranged substantially horizontal and parallel to each other. In this manner, the presence of the front, rear, and intermediate wires 304, 312, 326 in the space below the shelf 204 can be minimized, thereby maximizing storage space below the shelf 204.

The front, rear, and intermediate wires 304, 312, 326 described above can be rotatably coupled to the shelf 204 in a variety of different manners. For example, as shown in FIG. 22, the left trim member 222*c* of the shelf 204 can define a plurality of cylindrical bodies 354 that are each configured to rotatably receive a left end portion 356 of an associated wire. In particular, each cylindrical body 354 can be arranged substantially coincident with the rotational axis of its associated wire and can define a recess 358 for receiving the left end portion 356 of its associated wire. The right trim member 222*d* of the shelf 204 can similarly define a plurality of cylindrical bodies that can similarly be configured to rotatably receive right end portions of the front, rear, and intermediate wires 304, 312, 326.

However, it is to be appreciated that the cylindrical bodies 354 described above can be defined by other structure of the shelf 204 in some embodiments such as, for example, another trim member 222 or the panel 206 itself. Moreover, alternative structure may be provided in place of the cylindrical bodies for rotatably coupling the front, rear, and intermediate wires 304, 312, 326 to the shelf 204.

In some examples, the wine rack 302 can include one or more cam features that are configured to inhibit rotation of the wine rack 302 between its deployed configuration and stored configuration. For instance, FIG. 24 shows a close-up view of a front cylindrical body 354*a* with the front wire 304 removed for ease of illustration. The front cylindrical body 354*a* can comprise a cam surface 362 that can engage the front wire 304 to inhibit rotation of the wire about its rotational axis. In particular, the cam surface 362 can define a pair of valleys 366 that are circumferentially spaced about its cylindrical body 354 and are recessed axially into the cylindrical body 354. Moreover, the cam surface 362 can further define a lobe 368 that separates its valleys 366 and extends in the cylindrical body's axial direction.

When the wine rack 302 is in its stored configuration, an undulation portion 306 of the front wire 304 will reside in the upper valley 366 of the cam surface 362. As the wine rack 302 is rotated from its stored configuration toward its deployed configuration, the front wire 304 will rotate accordingly and the lobe 368 of the cam surface 362 will interfere with the undulation portion 306 of the front wire 304, thereby inhibiting further rotation of the wine rack 302 toward its deployed configuration. However, if sufficient rotating force is applied to the wine rack 302, the front wire 304 will compress axially along its rotation axis $R_1$, allowing the undulation portion 306 to surpass the lobe 368 and enter the lower valley 366 of the cam surface 362. The wine rack 302 can then assume its deployed configuration without interference from the lobe 368. If the wine rack 302 is later rotated from its deployed position to its stored configuration, the lobe 368 of the cam surface 362 will similarly interfere with the undulation portion 306 of the front wire 304 and inhibit rotation from the deployed position toward the stored configuration.

It is to be appreciated that the cam surface 362 described above may be provided on any one or more cylindrical bodies 354 of the shelf assembly 202. Indeed, in some examples, every cylindrical body 354 may similarly include a cam surface that engages its associated wire to inhibit rotation of the wine rack 302 between its deployed configuration and stored configuration. Moreover, in some examples, the wine rack 302 may have additional or alternative structure from its cam surface 362 described above for inhibiting rotation of the wine rack 302 such as, for example, one or more locking features.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

The invention claimed is:

1. A cover for a storage bin of a refrigerator, the cover comprising:

a panel having an upper surface for storing food items thereon that is substantially planar and substantially horizontal, the panel separating an upper space located above the panel from a lower space located below the panel; and a communication portion that is configured to provide fluid communication between the upper space and lower space, the communication portion comprising:

an upward-facing recessed surface, one or more side wall portions that extend above and at least partially bound the recessed surface, and a plurality of apertures that extend through the recessed surface and provide fluid communication between the upper space and lower space, wherein the recessed surface and the one or more side wall portions collectively define a recess, and wherein the cover further comprises an insert member that is received in the recess, and the insert member includes a first member and a second member, the second member comprises an exposed upper portion that is substantially flush with an upper portion of the first member, and the second member further comprises:

a breathable membrane, a frame portion configured to hold the breathable membrane, and an overhang portion extending upwardly from the frame portion and at least partially extending over the breathable membrane.

2. The cover according to claim 1, wherein the insert member is adapted to be flush with a top of the one or more side wall portions.

3. The cover according to claim 2, wherein the second member comprises a paper-based material.

4. The cover according to claim 2, wherein the frame portion extends at least partially about a perimeter of the breathable membrane.

5. The cover according to claim 2, wherein the first member and the second member are removably connected to each other, wherein:

the first member includes a U-shaped upper portion and a plurality of side walls that extend from the upper portion.

6. The cover according to claim 1, wherein the cover comprises a frame that is coupled to the panel and extends at least partially about a perimeter of the panel.

7. The cover according to claim 6, wherein:

the upper surface of the panel comprises a front edge, a rear edge, a left edge, and a right edge, and the frame includes a front trim member that extends along the front edge, a rear trim member that extends along the rear edge, a left trim member that extends along the left edge, and a right trim member that extends along the right edge.

8. The cover according to claim 7, wherein the communication portion is defined by one of the left trim member and right trim member of the frame.

9. The cover according to claim 6, wherein the frame is integrally formed as a monolithic body and defines the communication portion of the cover.

10. The cover according to claim 1, wherein the cover is arranged in a storage compartment of the refrigerator, above the storage bin.

11. The cover according to claim 1, wherein the panel extends in a first plane, and the upward-facing recessed surface is located below the first plane.

12. The cover according to claim 1, wherein the communication portion includes an upwardly extending projection, and wherein the insert member defines a recess, wherein recess is dimensioned to receive the upwardly extending projection to align the insert member into the recess of the communication portion.

13. The cover according to claim 1, wherein the communication portion defines a recess, and wherein the insert member comprises a downwardly extending projection that is configured to be received by the recess to align the insert member into the recess of the communication portion.

14. The cover according to claim 1, wherein the insert member comprises a downwardly extending latching arm, and wherein the communication portion defines an opening, wherein the latching arm is configured to extend through the opening to secure the insert member within the recess.

15. A cover for a storage bin of a refrigerator, the cover comprising:

a panel having an upper surface for storing food items thereon that is substantially planar and substantially horizontal, the panel separating an upper space located above the panel from a lower space located below the panel; and a communication portion that is configured to provide fluid communication between the upper space and lower space, the communication portion comprising:

an upward-facing recessed surface, one or more side wall portions that extend above and at least partially bound the recessed surface, and a plurality of apertures that extend through the recessed surface and provide fluid communication between the upper space and lower space, wherein the recessed surface and the one or more side wall portions collectively define a recess, and wherein the cover further comprises an insert member that is removably inserted into the recess such that the insert member is flush with a top of the one or more side wall portions, and wherein the insert member comprises moisture-absorbing material, wherein the insert member further comprises a body defining an upper portion and a leg portion extending downwardly from the body, wherein the leg portion is configured to rest against the recessed surface to space the upper portion relative to the recessed surface to define a chamber therebetween, and wherein the upper portion defines a slot extending between an upper surface and a lower surface thereof adapted to enable fluid communication between the chamber and the upper space.

16. The cover according to claim 15, wherein the communication portion includes an upwardly extending projection, and wherein the insert member defines a recess, wherein recess is dimensioned to receive the upwardly extending projection to align the insert member into the recess of the communication portion.

17. The cover according to claim 15, wherein the communication portion defines a recess, and wherein the insert member comprises a downwardly extending projection that is configured to be received by the recess to align the insert member into the recess of the communication portion.

18. The cover according to claim 15, wherein the insert member comprises a downwardly extending latching arm, and wherein the communication portion defines an opening, wherein the latching arm is configured to extend through the opening to secure the insert member within the recess.

19. The cover according to claim 18, wherein the latching arm further comprises a catch that is configured to engage with an underside of the communication portion to lock the insert member to the communication portion.

* * * * *